US009384876B2

(12) United States Patent
Tsukada et al.

(10) Patent No.: US 9,384,876 B2
(45) Date of Patent: Jul. 5, 2016

(54) CHIP RESISTOR, MOUNTING STRUCTURE FOR CHIP RESISTOR, AND MANUFACTURING METHOD FOR CHIP RESISTOR

(71) Applicant: ROHM CO., LTD., Kyoto-shi, Kyoto (JP)

(72) Inventors: Torayuki Tsukada, Kyoto (JP); Kentaro Naka, Kyoto (JP)

(73) Assignee: ROHM CO., LTD., Kyoto (JP)

( * ) Notice: Subject to any disclaimer, the term of this patent is extended or adjusted under 35 U.S.C. 154(b) by 178 days.

(21) Appl. No.: 14/350,672

(22) PCT Filed: Oct. 12, 2012

(86) PCT No.: PCT/JP2012/076481

§ 371 (c)(1),
(2) Date: Apr. 9, 2014

(87) PCT Pub. No.: WO2013/054898

PCT Pub. Date: Apr. 18, 2013

(65) Prior Publication Data

US 2014/0247108 A1 Sep. 4, 2014

(30) Foreign Application Priority Data

Oct. 14, 2011 (JP) ..... 2011-226646

(51) Int. Cl.
*H01C 1/012* (2006.01)
*H01C 7/00* (2006.01)
(Continued)

(52) U.S. Cl.
CPC ..... *H01C 7/00* (2013.01); *H01C 7/003* (2013.01); *H01C 17/00* (2013.01); *H01C 17/006* (2013.01);
(Continued)

(58) Field of Classification Search
CPC ..... H01C 17/242; H01C 7/00; H01C 17/006; H01C 17/02; H01C 17/065; H01C 17/00
USPC ..... 338/309, 307, 313, 327, 329
See application file for complete search history.

(56) References Cited

U.S. PATENT DOCUMENTS 5,287,083 A * 2/1994 Person ..... H01C 17/006 338/293
5,604,477 A * 2/1997 Rainer ..... H01C 17/006 29/621

(Continued)

FOREIGN PATENT DOCUMENTS

JP 3321724 6/2002
JP 2006-60126 3/2006

(Continued)

OTHER PUBLICATIONS

Office Action issued in corresponding Japanese Patent Application No. 2011-226646 on Jan. 26, 2016 (4 pages).

*Primary Examiner* — Kyung Lee
(74) *Attorney, Agent, or Firm* — Hamre, Schumann, Mueller & Larson, P.C.

(57) ABSTRACT

A chip resistor includes a first electrode 1, a second electrode 2, a resistor portion 3, a first intermediate layer 4 connected to the first electrode 1 and the resistor portion 3, a second intermediate layer 5 connected to the second electrode 2 and the resistor portion 3, a coating film 61 covering the first electrode 1, and oxides existing in the first intermediate layer 4. The coating film 61 is made of a material having a higher absorptance of a laser beam of a predetermined wavelength than that of the material forming the first electrode 1. The oxides are oxides of the material forming the coating film 61.

22 Claims, 36 Drawing Sheets

(51) Int. Cl.
*H01C 17/242* (2006.01)
*H01C 17/00* (2006.01)
*H01C 17/02* (2006.01)
*H01C 17/065* (2006.01)

(52) U.S. Cl.
CPC ..... *H01C 17/02* (2013.01); *H01C 17/065* (2013.01); *H01C 17/242* (2013.01); *Y10T 29/49082* (2015.01)

(56) References Cited

U.S. PATENT DOCUMENTS 6,401,329 B1 * 6/2002 Smejkal ..... H01C 3/12 29/619
7,042,328 B2 * 5/2006 Schneekloth ..... H01C 1/084 338/51
7,053,749 B2 * 5/2006 Ishida ..... H01C 1/44 338/323
RE39,660 E * 5/2007 Szwarc ..... H01C 7/13 219/216
7,217,374 B2 * 5/2007 Watanabe ..... B82Y 10/00 252/502
8,183,976 B2 * 5/2012 Lo ..... H01C 1/148 338/20
8,319,598 B2 * 11/2012 Zandman ..... H01C 1/014 338/195
8,531,264 B2 * 9/2013 Li ..... H01C 7/06 338/195
2003/0201871 A1 * 10/2003 Chern ..... H01C 1/084 338/309
2004/0216303 A1 * 11/2004 Berlin ..... H01C 7/003 29/610.1
2005/0258930 A1 * 11/2005 Ishida ..... H01C 1/144 338/309
2011/0063072 A1 * 3/2011 Lo ..... H01C 1/148 338/314

FOREIGN PATENT DOCUMENTS

JP 2008-16870 A 1/2008
JP 2009-71123 4/2009
JP 2011-159682 A 8/2011

* cited by examiner

CHIP RESISTOR, MOUNTING STRUCTURE FOR CHIP RESISTOR, AND MANUFACTURING METHOD FOR CHIP RESISTOR

TECHNICAL FIELD

The present invention relates to a chip resistor, a mount structure of a chip resistor and a method for manufacturing a chip resistor.

BACKGROUND ART

A conventionally known chip resistor (surface mount resistor) includes two leads and a central resistor portion (see Patent Document 1, for example). The central resistor portion is sandwiched between the two leads and bonded to the leads. This type of chip resistor is manufactured by using a plurality of reels. Specifically, a strip of a resistive material is wound around one of the reels, whereas a strip of an electrically conductive material is wound around each of other two reels. The strips are paid out from the reels while rotating the reels, and bonded together in such a manner that the strip of the resistive material is sandwiched between the two strips of an electrically conductive material.

In the technique disclosed in the above-identified document, a strip of a resistive material and a strip of an electrically-conductive material are bonded together by electron beam welding. Electron beam welding is performed in a vacuum atmosphere. Thus, to perform electron beam welding, after strips are placed in a vacuum chamber, the chamber needs to be evacuated. Placing each strip in a vacuum chamber and evacuating the chamber are troublesome. Moreover, after the strips are bonded together, the interior of the vacuum chamber needs to be returned to an atmospheric pressure, which is also troublesome. In this way, the conventional method of bonding strips by electron beam welding is not efficient.

TECHNICAL REFERENCE

Patent Document

Patent Document 1: Japanese Patent No. 3321724

SUMMARY OF THE INVENTION

Problems to be Solved by the Invention

The present invention has been conceived under the circumstances described above. It is therefore an object of the present invention to provide a chip resistor suitable for enhancing manufacturing efficiency.

Means for Solving the Problems

According to a first aspect of the present invention, there is provided a chip resistor comprising a first electrode, a second electrode spaced apart from the first electrode in a first direction, a resistor portion bonded to the first electrode and the second electrode, a first intermediate layer connected to the first electrode and the resistor portion, a second intermediate layer connected to the second electrode and the resistor portion, and a coating film covering the first electrode. The coating film is made of a material having a higher absorptance of a laser beam of a predetermined wavelength than that of a material forming the first electrode, and the first intermediate layer contains at least the material forming the coating film.

Preferably, the coating film is made of Sn or solder.

Preferably, the resistor portion extends along a plane spreading in the first direction and a second direction crossing the first direction. The first electrode includes a first principal surface facing one side in the thickness direction of the resistor portion. The coating film includes a first-principal-surface coating portion covering the first principal surface. The first-principal-surface coating portion covers the first principal surface over a region from an end closer to the second electrode in the first direction to an end opposite in the first direction from the end closer to the second electrode.

Preferably, the first electrode includes a second principal surface facing away from the first principal surface. The coating film includes a second-principal-surface coating portion covering the second principal surface.

Preferably, the second-principal-surface coating portion covers the second principal surface over a region from an end closer to the second electrode in the first direction to an end opposite in the first direction from the end closer to the second electrode.

Preferably, the second-principal-surface coating portion is made of the same material as the material forming the first-principal-surface coating portion.

Preferably, the first electrode includes a first side surface facing in the second direction, and the first side surface is exposed from the coating film.

Preferably, the first side surface includes a line-trace formed surface formed with a line trace, and a breakage-trace formed surface connected to the line-trace formed surface and formed with a breakage trace.

Preferably, the first electrode includes a second side surface and a curved surface connected to the first side surface and the second side surface. The second side surface faces in a direction away from the resistor portion in the first direction. The second side surface and the curved surface are exposed from the coating film.

Preferably, the first electrode includes a second side surface. The second side surface faces in a direction away from the resistor portion in the first direction and is covered by the coating film.

Preferably, the resistor portion is sandwiched between the first electrode and the second electrode.

Preferably, the first intermediate layer includes a wide portion and a narrow portion. The wide portion and the narrow portion are exposed in opposite directions from each other.

Preferably, the first intermediate layer includes a wide portion and a narrow portion that is smaller than the wide portion in dimension in the first direction. The wide portion and the narrow portion are exposed in opposite directions from each other.

Preferably, the first electrode includes a plate-like portion extending along the first direction and a second direction crossing the first direction, and an inclined portion inclined with respect to the plate-like portion and closer to the resistor portion than the plate-like portion is.

Preferably, the first electrode and the second electrode are positioned on a same side of the resistor portion.

Preferably, the resistor portion is smaller in thickness than the first electrode.

Preferably, the chip resistor further comprises oxide existing in the first intermediate layer, and the oxide is oxide of a material forming the coating film.

According to a second aspect of the present invention, there is provided a mount structure of a chip resistor. The mount structure comprises the chip resistor provided according to the first aspect of the present invention, a mount board, and a solder layer provided between the mount board and the chip resistor.

According to a third aspect of the present invention, there is provided a chip resistor manufacturing method comprising the steps of preparing an electrically conductive member made of an electrically conductive material and a resistive member made of a resistive material, forming a coating film to cover the electrically conductive member, and bonding the electrically conductive member and the resistive member to each other by application of a laser beam of a predetermined wavelength after the step of forming the coating film. The coating film is formed of a material having a higher absorptance of the laser beam of the predetermined wavelength than that of the electrically conductive material. The bonding step comprises applying the laser beam to the coating film.

Preferably, the coating film is made of Sn or solder.

Preferably, the step of forming the coating film comprises plating.

Preferably, the preparation step comprises preparing a plurality of conductive elongated boards as the electrically conductive member. The method further comprises the step of arranging the conductive elongated boards side by side in the width direction crossing the longitudinal direction of one of the conductive elongated boards before the bonding step. The bonding step comprises bonding the resistive member to the conductive elongated boards to provide a resistor aggregate after the step of arranging.

Preferably, the method further comprises the step of dividing the resistor aggregate by punching to provide a chip resistor including two electrodes and a resistor portion bonded to the two electrodes.

Other features and advantages of the present invention will become more apparent from detailed description given below with reference to the accompanying drawings.

MODE FOR CARRYING OUT THE INVENTION

Embodiments of the present invention are described below with reference to the accompanying drawings.

First Embodiment

Figure 1:
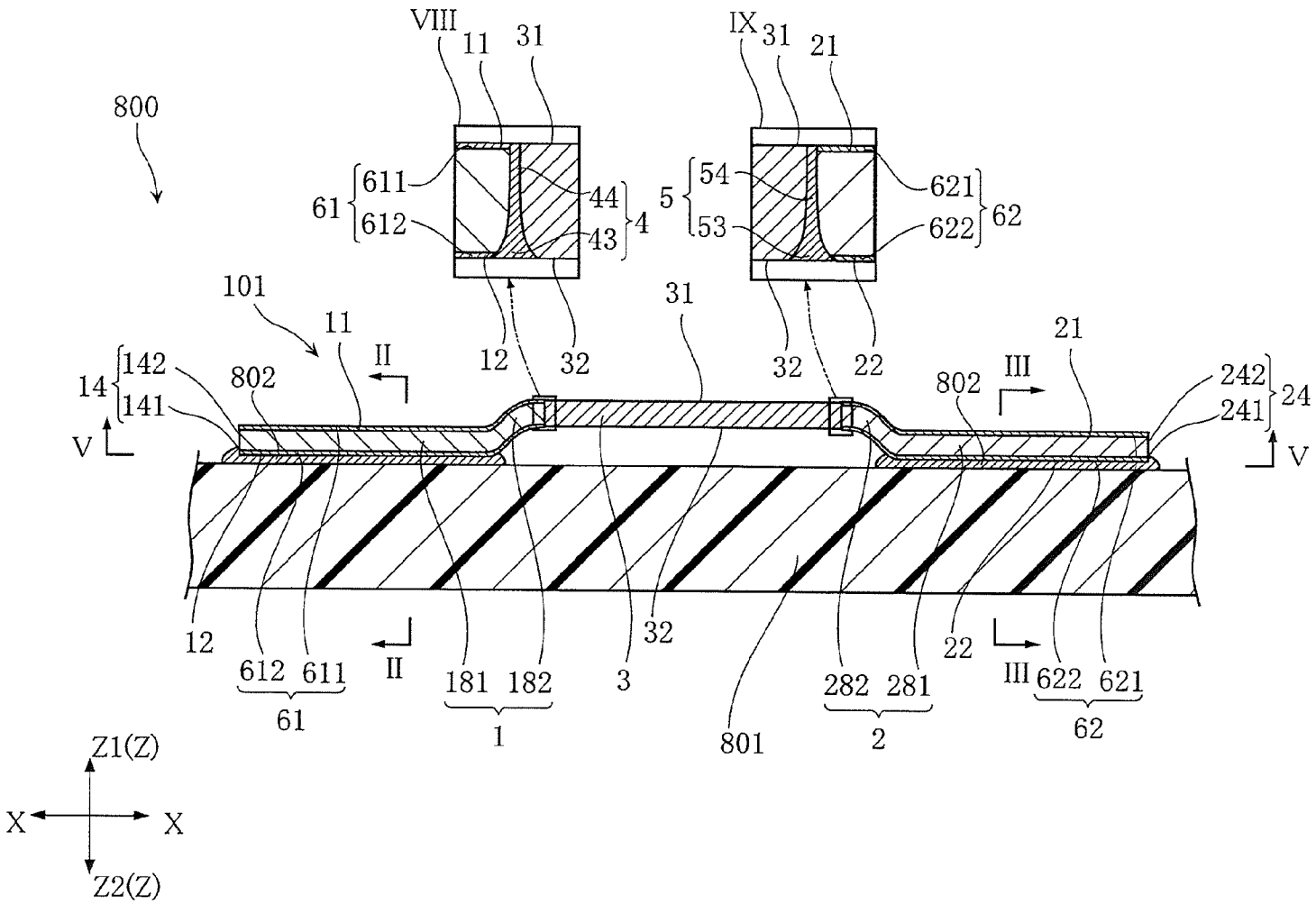
FIG. 1 is a sectional view of a mount structure of a chip resistor according to a first embodiment of the present invention.
Figure 2:
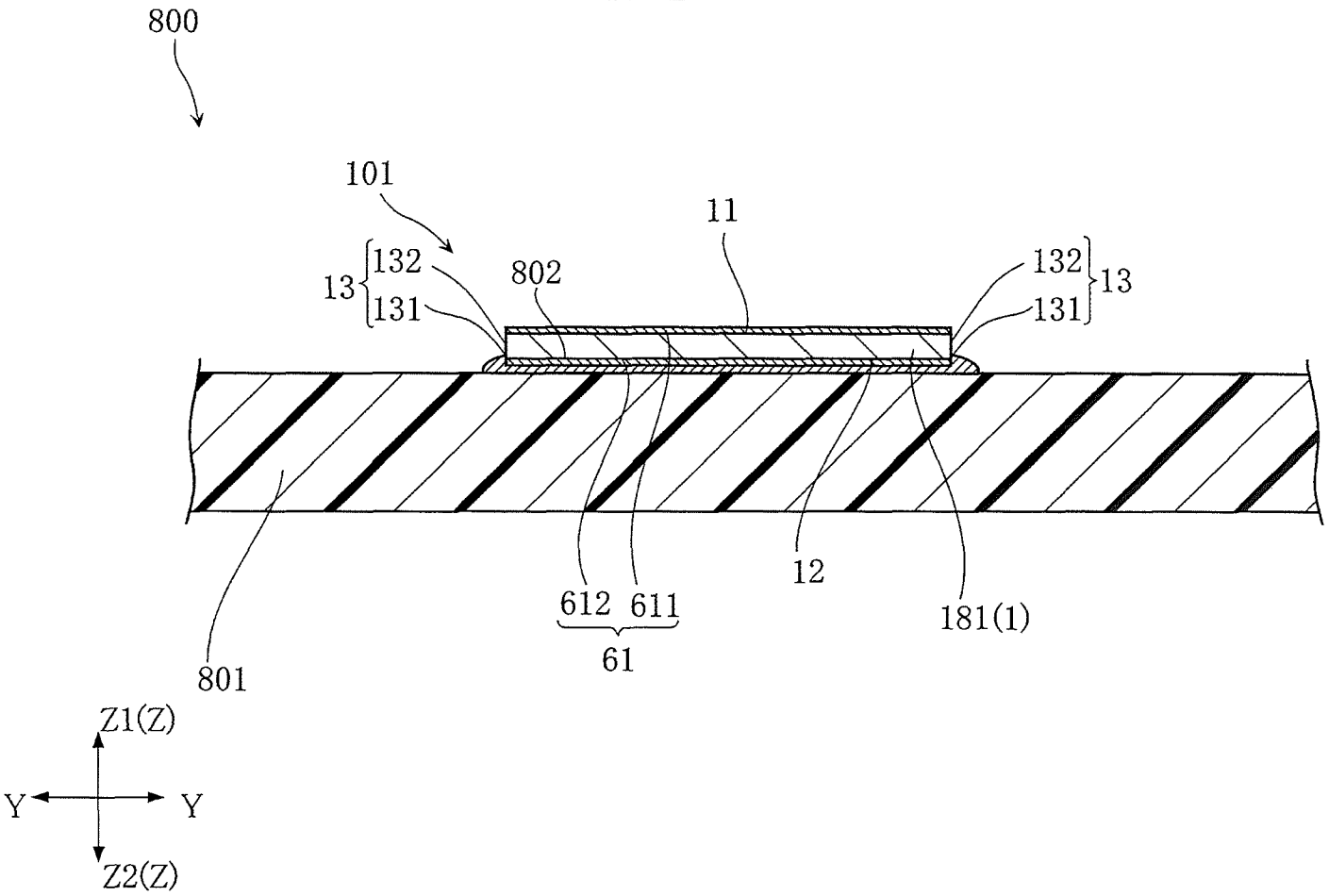
FIG. 2 is a sectional view taken along lines II-II in FIG. 1.
Figure 3:
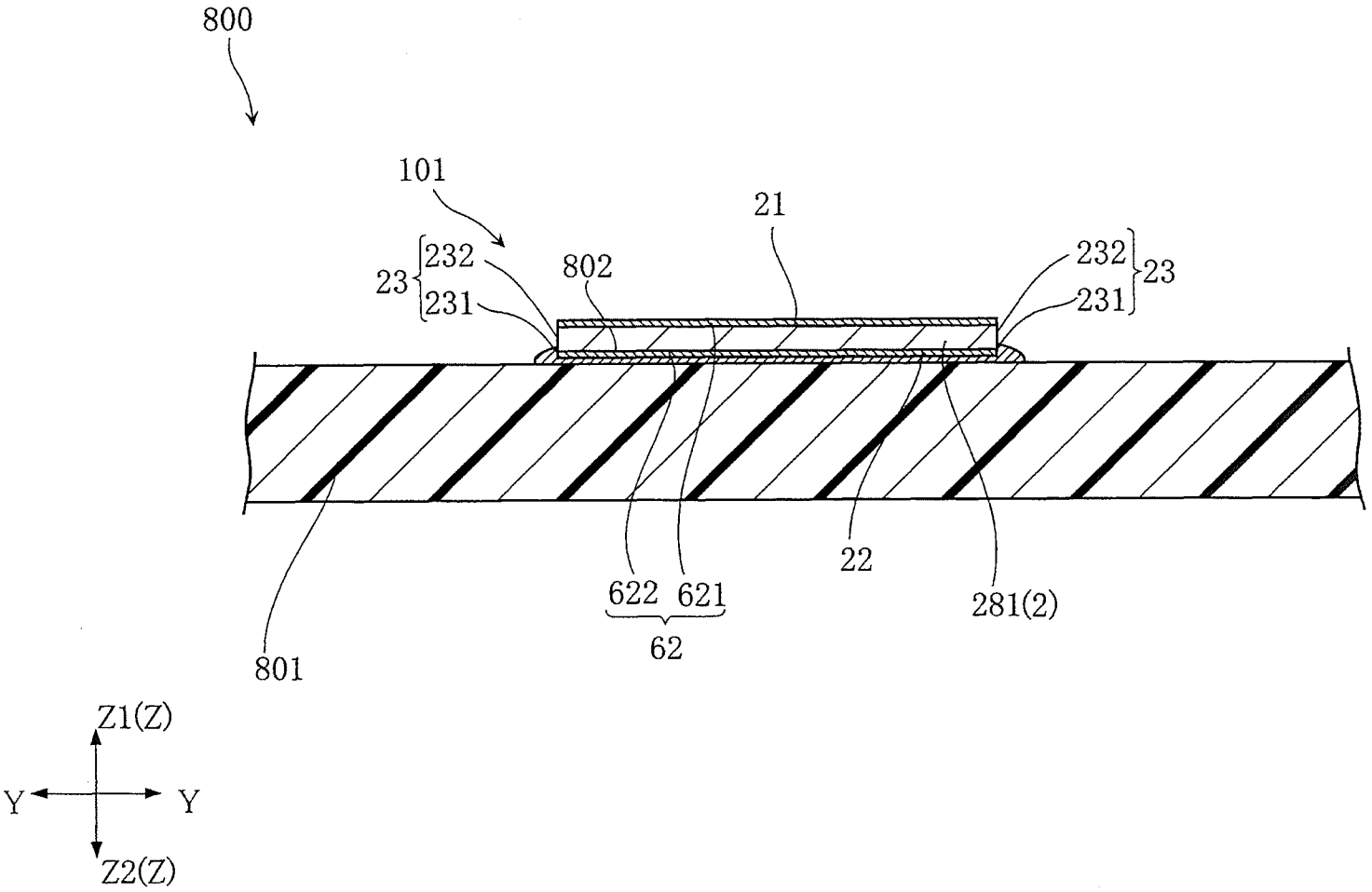
FIG. 3 is a sectional view taken along lines III-III in FIG. 1.
Figure 4:
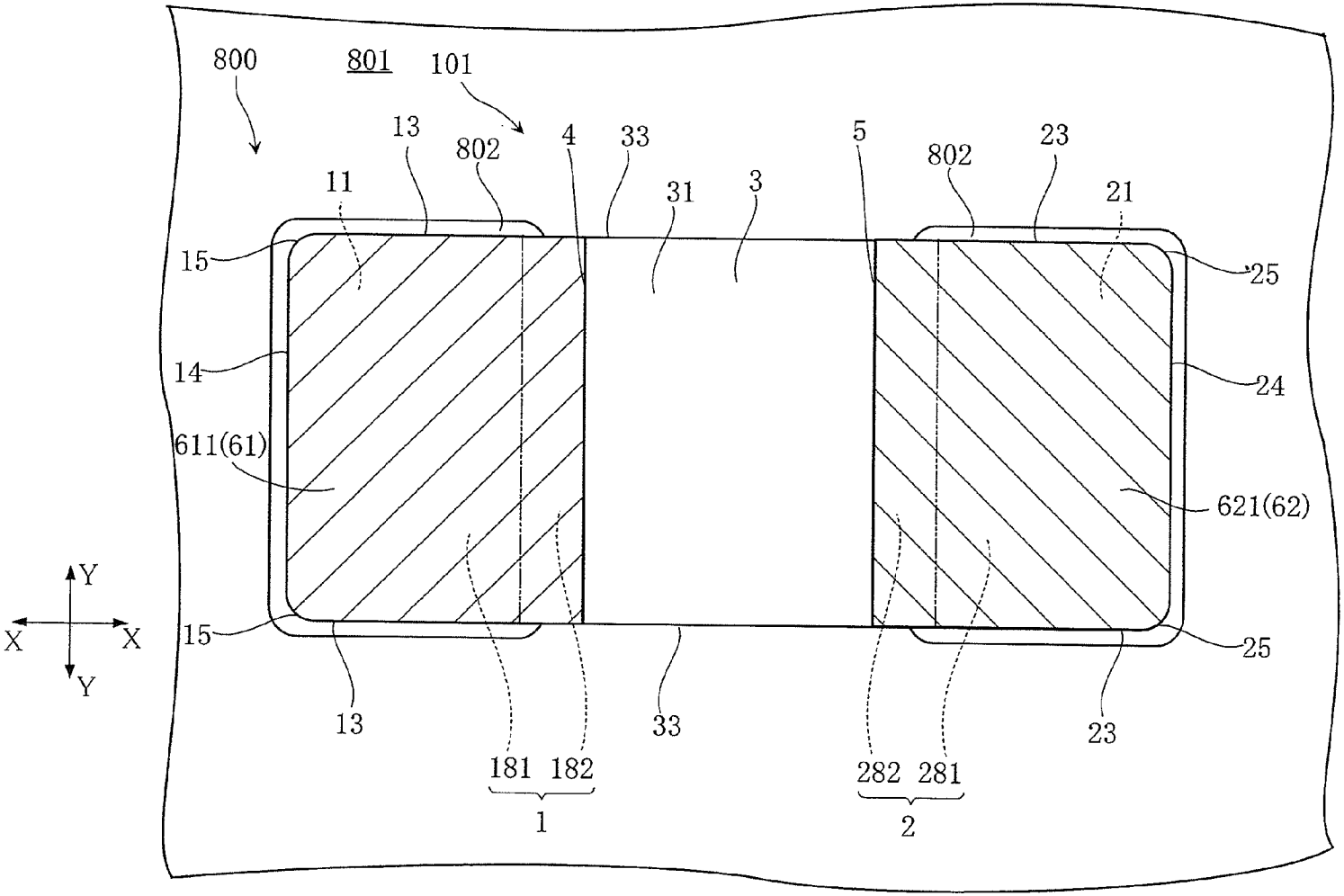
FIG. 4 is a plan view of a mount structure of the chip resistor shown in FIG. 1.
Figure 5:
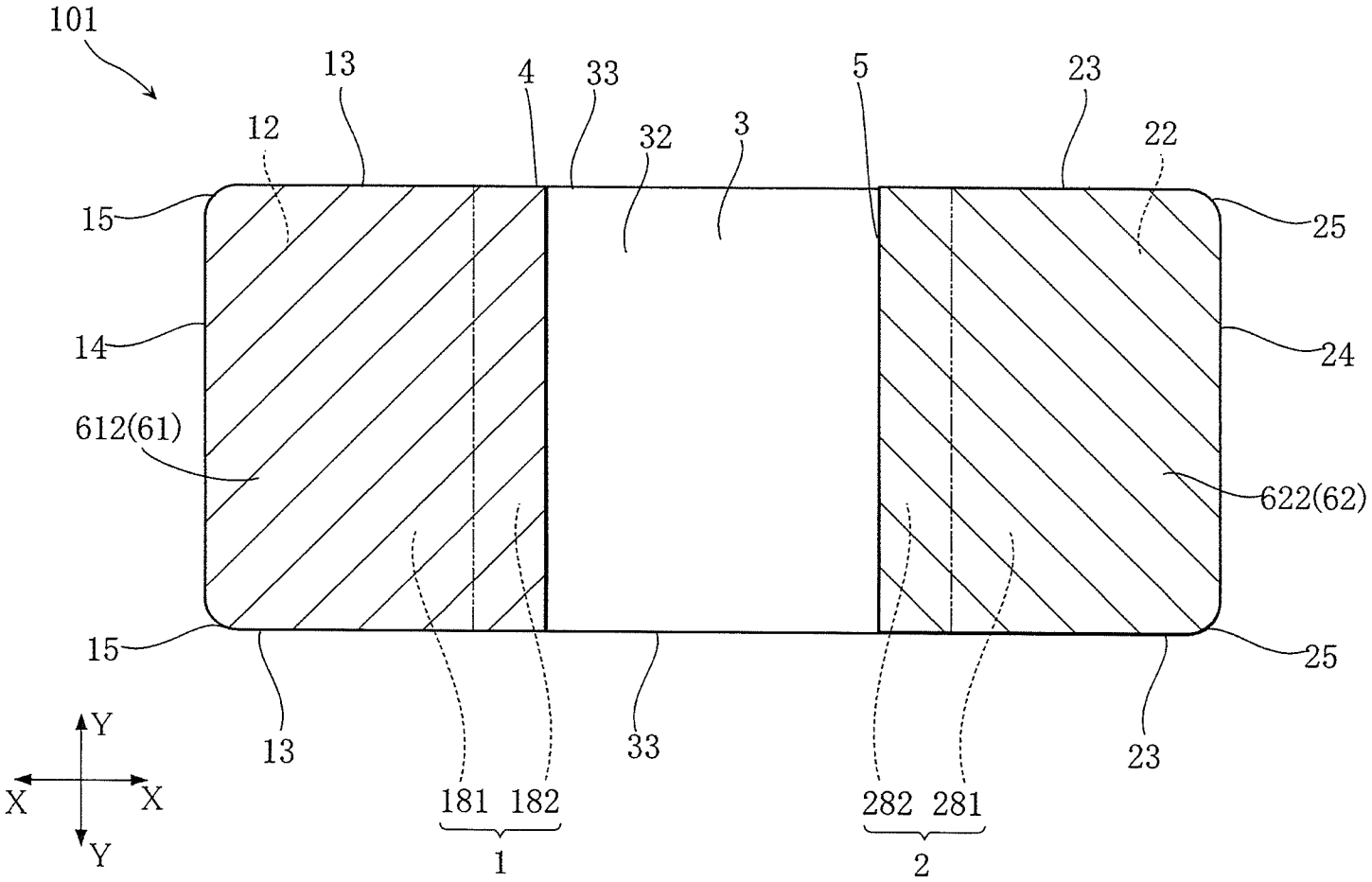
FIG. 5 is a view (partially omitted) along lines V-V in FIG. 1.
Figure 6:
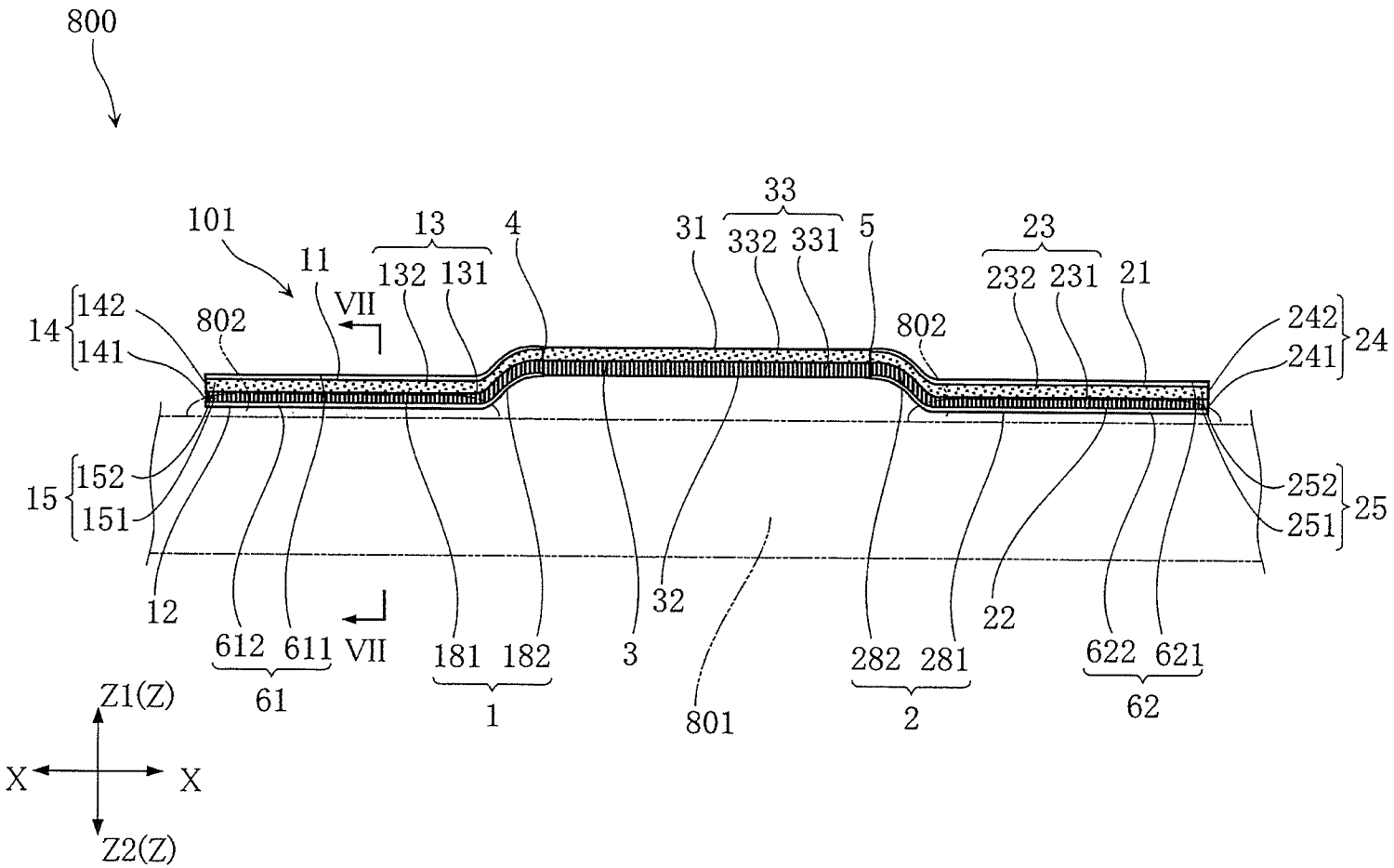
FIG. 6 is a front view of the chip resistor shown in FIG. 1.
Figure 7:
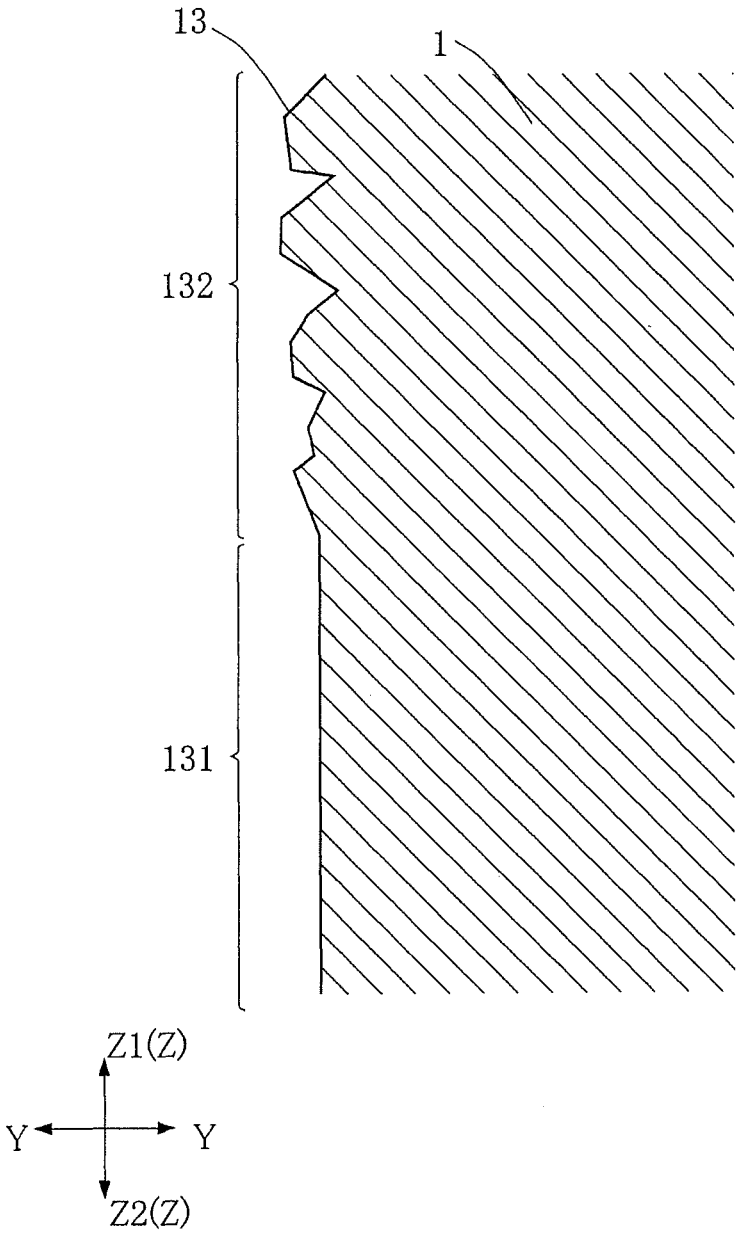
FIG. 7 is a partially enlarged sectional view taken along lines VII-VII in FIG. 6.
Figure 8:
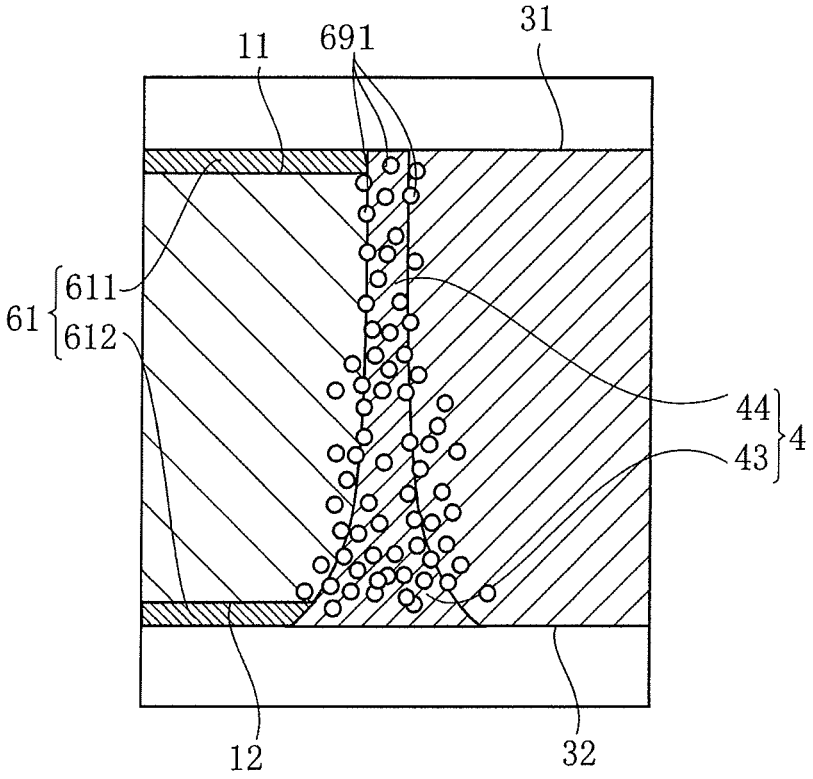
FIG. 8 is an enlarged view of the region VIII in FIG. 1.
Figure 9:
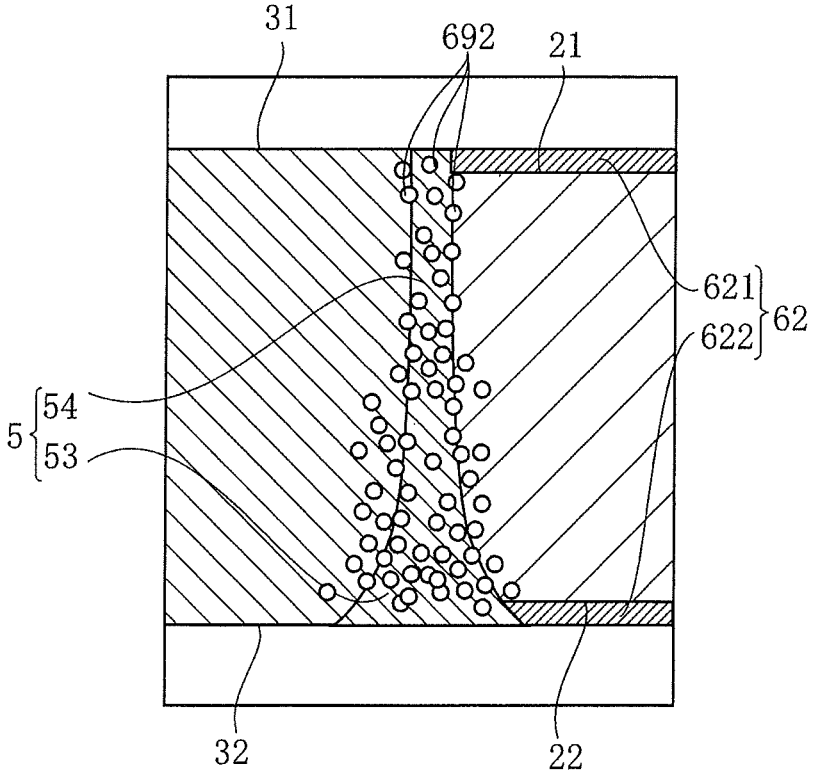
FIG. 9 is an enlarged view of the region IX in FIG. 1.

FIG. 1 is a sectional view of a mount structure of a chip resistor according to a first embodiment of the present invention. FIG. 2 is a sectional view taken along lines II-II in FIG. 1. FIG. 3 is a sectional view taken along lines III-III in FIG. 1. FIG. 4 is a plan view of the mount structure of the chip resistor shown in FIG. 1. FIG. 5 is a view (partially omitted) along lines V-V in FIG. 1. FIG. 6 is a front view of the chip resistor shown in FIG. 1. FIG. 7 is a partially enlarged sectional view taken along lines VII-VII in FIG. 6. FIG. 8 is an enlarged view of the region VIII in FIG. 1. FIG. 9 is an enlarged view of the region IX in FIG. 1;

The chip resistor mount structure 800 shown in these figures includes a chip resistor 101, a mount board 801 and a solder layer 802.

For instance, the mount board 801 is a printed circuit board. For instance, the mount board 801 includes an insulating substrate and a pattern electrode (not shown) formed on the insulating substrate. The chip resistor 101 is mounted on the mount board 801. A solder layer 802 is provided between the chip resistor 101 and the mount board 801. The solder layer 802 bonds the chip resistor 101 and the mount board 801 to each other.

The chip resistor 101 includes a first electrode 1, a second electrode 2, a resistor portion 3, a first intermediate layer 4, a second intermediate layer 5, a coating film 61, a coating film 62, oxides 691 (not shown in FIG. 1, see FIG. 8) and oxides 692 (not shown in FIG. 1, see FIG. 9). In FIGS. 4 and 5, the regions where the coating film 61 or the coating film 62 is formed are indicated by hatching.

The first electrode 1 shown in FIGS. 1-6 is made of an electrically conductive material such as Cu, Ni or Fe. For instance, the first electrode 1 is 0.2-1.5 mm in thickness. When the chip resistor 101 is mounted on the mount board 801, the first electrode 1 is bonded to the solder layer 802. The first electrode 1 is electrically connected to the pattern electrode (not shown) of the mount board 801 via the solder layer 802. In this embodiment, the first electrode 1 includes a plate-like portion 181 and an inclined portion 182.

The plate-like portion 181 shown in FIGS. 1, 4 and 5 extends along the X-Y plane. The plate-like portion 181 constitutes the most part of the first electrode 1. The inclined portion 182 is inclined with respect to the X-Y plane. Specifically, the inclined portion 182 is inclined so as to be deviated toward the direction Z1 as proceeding further away from the plate-like portion 181. The inclined portion 182 is in the form of a strip extending along the direction Y. The inclined portion 182 is connected to the plate-like portion 181.

The first electrode 1 includes a principal surface 11 (second principal surface), a principal surface 12 (first principal surface), two side surfaces 13 (first side surfaces), a side surface 14 (second side surface) and two curved surfaces 15.

The principal surface 11 faces in the direction Z1 (one side in the thickness direction of the resistor portion 3). The principal surface 12 faces in the direction Z2 (i.e., faces away from the principal surface 11). The side surfaces 13, 14 and the curved surface 15 face in a direction perpendicular to the direction z. Specifically, the side surfaces 13 face in the direction Y and the side surface 14 faces in the direction X. The curved surfaces 15 are connected to the side surfaces 13 and the side surface 14.

As shown in FIGS. 6 and 7, the side surface 13 includes a line-trace formed surface 131 and a breakage-trace formed surface 132. The line-trace formed surface 131 is formed with a trace of lines. The trace of lines includes a plurality of thin, elongated grooves extending in the direction Z. The breakage-trace formed surface 132 is connected to the line-trace formed surface 131. The breakage-trace formed surface 132 is formed with a breakage trace. The breakage trace is an irregular trace formed when a metal is torn off. As shown in FIG. 6, in this embodiment, the line-trace formed surface 131 is closer to the principal surface 12 than the breakage-trace formed surface 132 is. When the chip resistor 101 is mounted on the mount board 801, the line-trace formed surface 131 is covered by the solder layer 802. According to this arrangement, solder enters the grooves of the line-trace formed surface 131, whereby a relatively large area of the side surface 13 is covered by the solder layer 802. Unlike this embodiment, the breakage-trace formed surface 132 may be arranged closer to the principal surface 12 than the line-trace formed surface 131 is.

As shown in FIG. 6, similarly to the side surfaces 13, the side surface 14 has a line-trace formed surface 141 and a breakage-trace formed surface 142. Since the line-trace formed surface 141 and the breakage-trace formed surface 142 of the side surface 14 are similar to the line-trace formed surface 131 and the breakage-trace formed surface 132 of the side surfaces 13, the explanation is omitted.

As shown in FIG. 6, similarly to the side surfaces 13, each curved surface 15 has a line-trace formed surface 151 and a breakage-trace formed surface 152. Since the line-trace formed surface 151 and the breakage-trace formed surface 152 of the curved surface 15 are similar to the line-trace formed surface 131 and the breakage-trace formed surface 132 of the side surfaces 13, the explanation is omitted.

The second electrode 2, which is shown in FIGS. 1-6, is made of an electrically conductive material such as Cu, Ni or Fe. For instance, the second electrode 2 is 0.2-1.5 mm in thickness. When the chip resistor 101 is mounted on the mount board 801, the second electrode 2 is bonded to the solder layer 802. The second electrode 2 is electrically connected to the pattern electrode (not shown) of the mount board 801 via the solder layer 802. In this embodiment, the second electrode 2 includes a plate-like portion 281 and an inclined portion 282.

The plate-like portion 281, which is shown in FIGS. 1, 4 and 5, extends along the X-Y plane. The plate-like portion 281 constitutes the most part of the second electrode 2. The inclined portion 282 is inclined with respect to the X-Y plane. Specifically, the inclined portion 282 is inclined so as to be deviated toward the direction Z1 as proceeding further away from the plate-like portion 281. The inclined portion 282 is in the form of a strip extending along the direction Y. The inclined portion 282 is connected to the plate-like portion 281.

The second electrode 2 includes a principal surface 21, a principal surface 22, two side surfaces 23, a side surface 24 and two curved surfaces 25. The second electrode 2 is spaced apart from the first electrode 1 in the direction X (first direction).

The principal surface 21 faces in the direction Z1 (one side in the thickness direction of the resistor portion 3). The principal surface 22 faces in the direction Z2 (i.e., faces away from the principal surface 11). The side surfaces 23, 24 and the curved surface 25 face in a direction perpendicular to the direction Z. Specifically, the side surfaces 23 face in the direction Y and the side surface 24 faces in the direction X. The curved surfaces 25 are connected to the side surfaces 23 and the side surface 24.

As shown in FIG. 6, the side surface 23 includes a line-trace formed surface 231 and a breakage-trace formed surface 232. Since the line-trace formed surface 231 and the breakage-trace formed surface 232 of the side surface 23 are similar to the line-trace formed surface 131 and the breakage-trace formed surface 132 of the side surface 13, the explanation is omitted.

As shown in FIG. 6, similarly to the side surfaces 23, the side surface 24 has a line-trace formed surface 241 and a breakage-trace formed surface 242. Since the line-trace formed surface 241 and the breakage-trace formed surface 242 of the side surface 24 are similar to the line-trace formed surface 231 and the breakage-trace formed surface 232 of the side surfaces 23, the explanation is omitted.

As shown in FIG. 6, similarly to the side surfaces 23, the curved surface 25 has a line-trace formed surface 251 and a breakage-trace formed surface 252. Since the line-trace formed surface 251 and the breakage-trace formed surface 252 of the curved surfaces 25 are similar to the line-trace formed surface 231 and the breakage-trace formed surface 232 of the side surfaces 23, the explanation is omitted.

The resistor portion 3, which is shown in FIGS. 1 and 4-6 extends along the direction X which is the first direction and the direction Y which is the second direction. The resistor portion 3 is made of a resistive material. Examples of the resistive material include an alloy of Cu and Mn, an alloy of Ni and Cr, an alloy of Ni and Cu and an alloy of Fe and Cr. An alloy of Cu and Mn is relatively soft, whereas an alloy of Ni and Cr, an alloy of Ni and Cu and an alloy of Fe and Cr are relatively hard. The resistance of the resistive material forming the resistor portion 3 is higher than the resistance of the electrically conductive material forming the first electrode 1 or the second electrode 2. The resistor portion 3 is connected to first electrode 1 and the second electrode 2. In this embodiment, the resistor portion 3 is sandwiched between the first electrode 1 and the second electrode 2.

In this embodiment, the inclined portion 182 is closer to the resistor portion 3 than the plate-like portion 181 is. Similarly, the inclined portion 282 is closer to the resistor portion 3 than the plate-like portion 281 is.

The resistor portion 3 includes a resistor portion front surface 31, a resistor portion reverse surface 32 and two resistor portion side surfaces 33.

The resistor portion front surface 31 faces in the same direction as the principal surface 11 or the principal surface 21 (i.e., the direction Z1). The resistor portion reverse surface 32 faces in the opposite direction from the resistor portion front surface 31. The resistor portion reverse surface 32 faces in the same direction as the principal surface 12 or the principal surface 22 (i.e., the direction Z2). At least part of the principal surface 12 and at least part of the principal surface 22 are deviated from the resistor portion reverse surface 32 toward the side to which the resistor portion reverse surface 32 faces (i.e., the direction Z2).

Each of the resistor portion side surfaces 33, which are shown in e.g. FIGS. 4 and 6, faces in the direction (direction Y) that crosses the direction in which the first electrode 1 and the second electrode 2 are spaced apart from each other. As shown in FIG. 6, each resistor portion side surface 33 includes a line-trace formed surface 331 and a breakage-trace formed surface 332. Since the line-trace formed surface 331 and the breakage-trace formed surface 332 are similar to the line-trace formed surface 131 and the breakage-trace formed surface 132, respectively, the explanation is omitted.

As shown in FIG. 8, the first intermediate layer 4 is provided between the first electrode 1 and the resistor portion 3. The first intermediate layer 4 is connected to the first electrode 1 and the resistor portion 3. In this embodiment, the first intermediate layer 4 is formed when a welding laser beam is applied to the first electrode 1 or the resistor portion 3 to bond the first electrode 1 and the resistor portion 3. Thus, the first intermediate layer 4 is made of a mixture of the material forming the first electrode 1, the material forming the resistor portion 3 and the material forming the coating film 61 (described later). That is, the first intermediate layer 61 contains at least the material forming the coating film 61.

Figure 21:
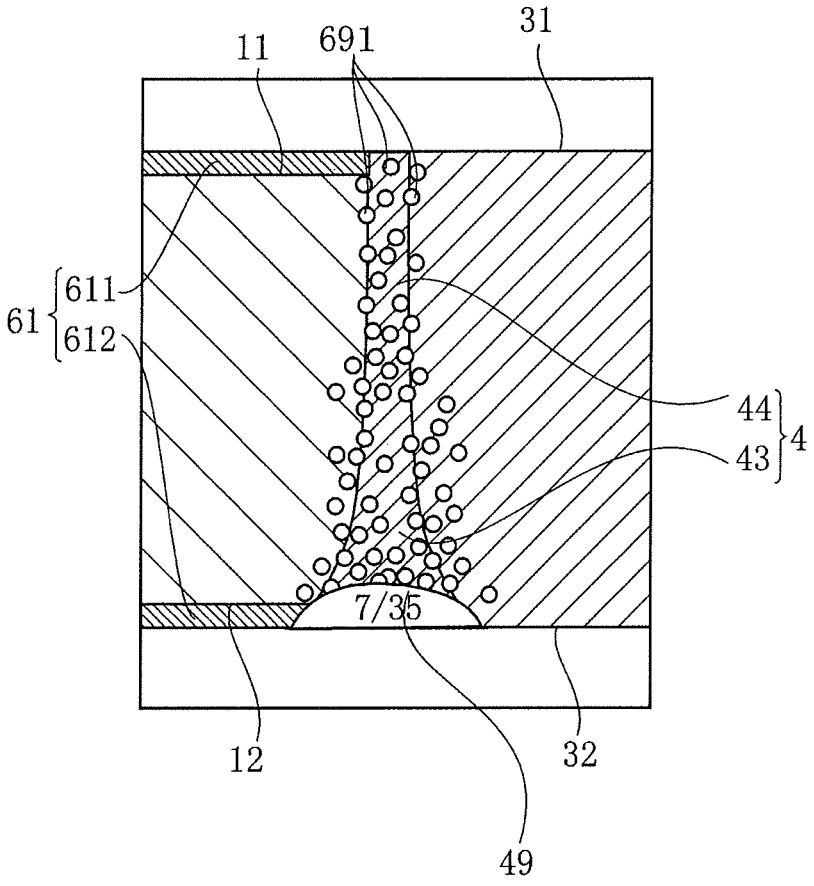
FIG. 21 is a schematic sectional view of a variation of a first intermediate layer of the chip resistor according to the first embodiment of the present invention.

The first intermediate layer 4 includes a wide portion 43 and a narrow portion 44. The wide portion 43 is exposed to the direction Z2. The narrow portion 44 is on the direction Z1 side of the wide portion 43. The dimension of the narrow portion 44 in the direction X is smaller than the dimension of the wide portion 43 in the direction X. That is, the width of the wide portion 43 is larger than that of the narrow portion 44. The width of the first intermediate layer 4 refers to the dimension in the direction in which the portion of the first electrode 1 which is in contact with the first intermediate layer 4 and the portion of the resistor portion 3 which is in contact with the first intermediate layer 4 are spaced apart from each other. For instance, the dimension of the wide portion 43 in the direction X is 1-1.5 mm, whereas the dimension of the narrow portion 44 in the direction X is 0.5-1 mm. The wide portion 43 may have burr (not shown) on the surface. Unlike this embodiment, the first intermediate layer 4 may be formed with a recess 49, as shown in FIG. 21. The recess 49 is formed by chipping off a part of the first intermediate layer 4 to remove burrs (not shown) on the surface of the wide portion 43.

As shown in FIG. 9, similarly to the first intermediate layer 4, the second intermediate layer 5 is provided between the second electrode 2 and the resistor portion 3. The second intermediate layer 5 is connected to the second electrode 2 and the resistor portion 3. In this embodiment, the second intermediate layer 5 is formed when a welding laser beam is applied to the second electrode 2 or the resistor portion 3 to bond the second electrode 2 and the resistor portion 3. Thus, the second intermediate layer 5 is made of a mixture of the material forming the second electrode 2, the material forming the resistor portion 3 and the material forming the coating film 62 (described later). That is, the second intermediate layer 62 contains at least the material forming the coating film 61.

Figure 22:
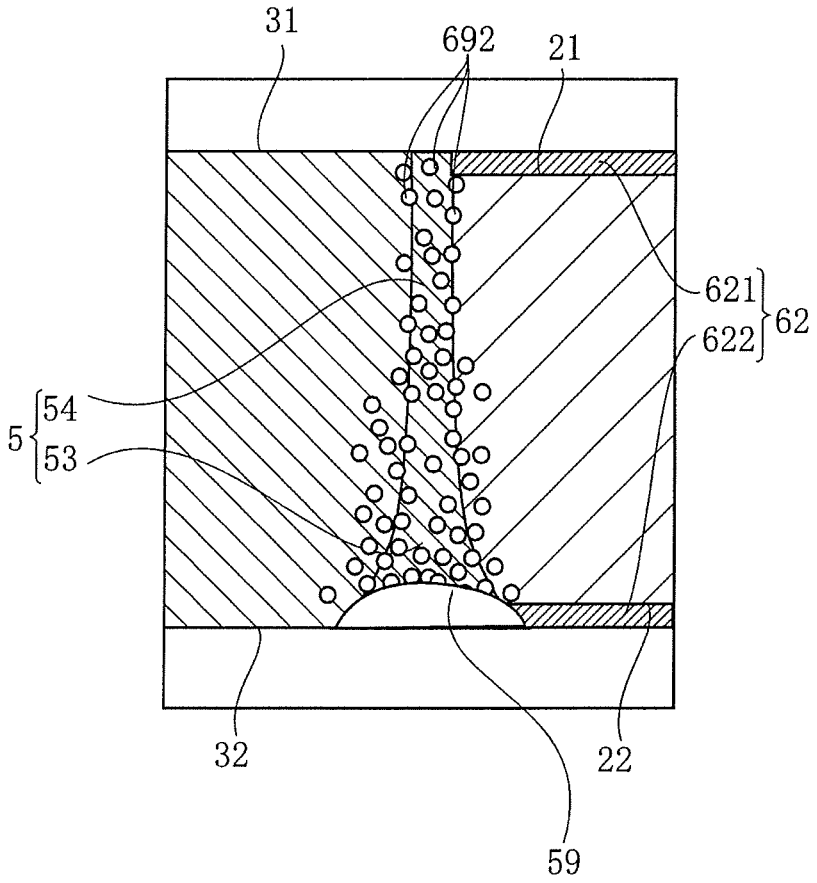
FIG. 22 is a schematic sectional view of a variation of a second intermediate layer of the chip resistor according to the first embodiment of the present invention.

The second intermediate layer 5 includes a wide portion 53 and a narrow portion 54. The wide portion 53 is exposed to the direction Z2. The narrow portion 54 is on the direction Z1 side of the wide portion 53. The dimension of the narrow portion 54 in the direction X is smaller than the dimension of the wide portion 53 in the direction X. That is, the width of the wide portion 53 is larger than that of the narrow portion 54. The width of the second intermediate layer 5 refers to the dimension in the direction in which the portion of the second electrode 2 which is in contact with the second intermediate layer 5 and the portion of the resistor portion 3 which is in contact with the second intermediate layer 5 are spaced apart from each other. For instance, the dimension of the wide portion 53 in the direction X is 1-1.5 mm, whereas the dimension of the narrow portion 54 in the direction X is 0.5-1 mm. The wide portion 53 may have burr (not shown) on the surface. Unlike this embodiment, the second intermediate layer 5 may be formed with a recess 59, as shown in FIG. 22. The recess 59 is formed by chipping off a part of the second intermediate layer 5 to remove burrs (not shown) on the surface of the wide portion 53.

The coating film 61 covers the first electrode 1. The material forming the coating film 61 has a higher absorptance of a laser beam of a wavelength of $\lambda 1$ than that of the material forming the first electrode 1. For instance, the wavelength $\lambda 1$ is 1.03-1.10 μm and 1.05 μm in this embodiment.

Figure 10:
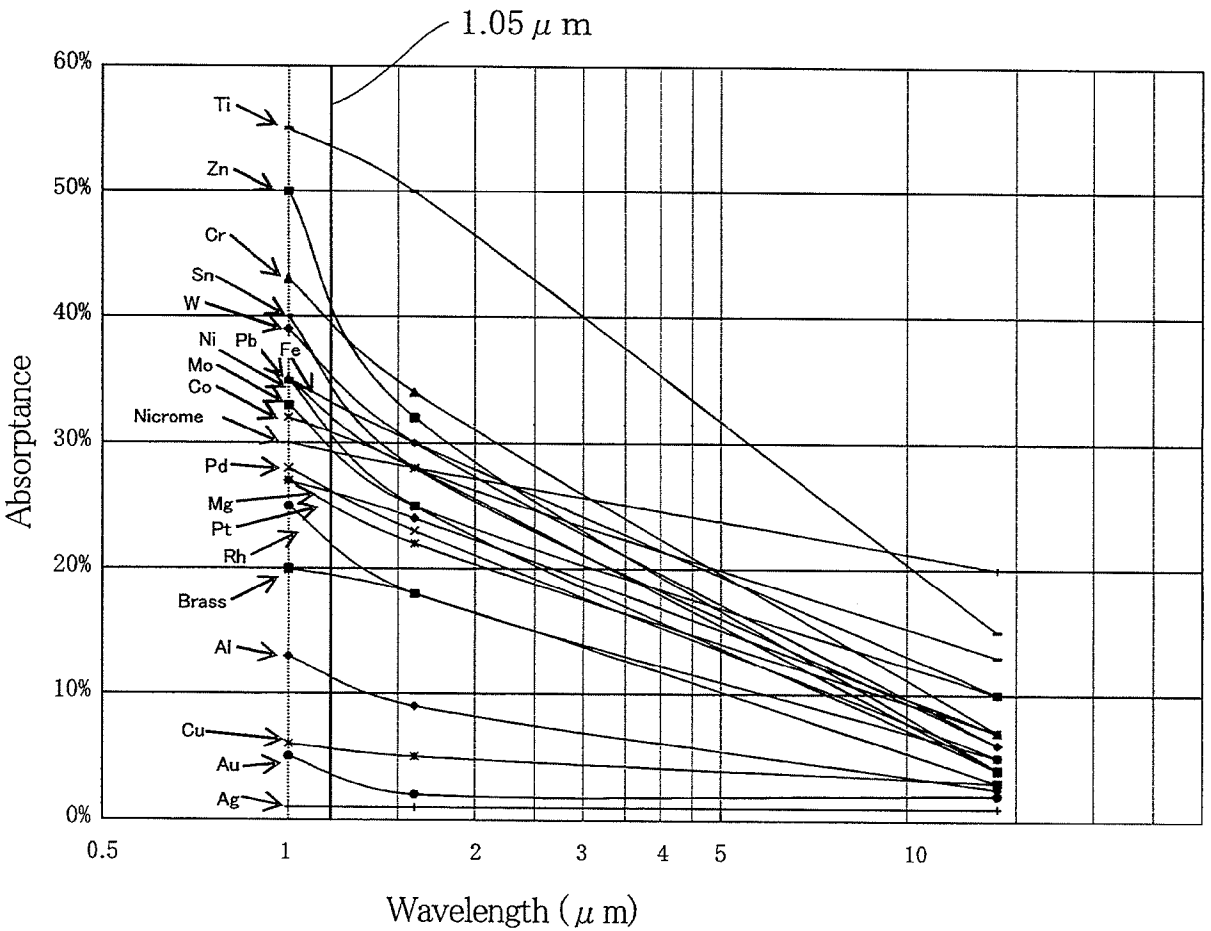
FIG. 10 is a graph showing the laser beam absorptance of various materials with respect to different wavelengths.

FIG. 10 is a graph showing the laser beam absorptance of various materials with respect to different wavelengths. The horizontal axis in the graph indicates the wavelength (μm), whereas the vertical axis indicates absorptance (%).

Referring to FIG. 10, when the wavelength $\lambda 1$ is 1.05 μm, Cu, Fe or Ni may be used as the material for the first electrode 1, and Sn or solder (mainly composed of Sn) may be used as the material for the coating film 61.

The coating film 61 includes a principal surface coating portion 611 (second-principal-surface coating portion) and a principal surface coating portion 612 (first-principal-surface coating portion). For instance, the thickness of the coating film 61 is about 5 μm.

The principal surface coating portion 611 covers the principal surface 11. In this embodiment, the principal surface coating portion 611 covers the entirety of the principal surface 11. As shown in FIG. 4, the principal surface coating portion 611 covers the end of the principal surface 11 which is on the opposite side from the second electrode 2 in the direction X. That is, the principal surface coating portion 611 covers the principal surface 11 in the neighborhood of the boundary between the principal surface 11 and the side surface 14. In this embodiment, the principal surface coating portion 611 covers the principal surface 11 from the end which is on the second electrode 2 side to the end on the opposite side from the second electrode 2 in the direction X. That is, the principal surface coating portion 611 covers the principal surface 11 from the neighborhood of the first intermediate layer 4 to the neighborhood of the boundary between the principal surface 11 and the side surface 14. The principal surface coating portion 611 covers the principal surface 11 from the boundary between one of the side surfaces 13 and the principal surface 11 to the boundary between the other one of the side surfaces 13 and the principal surface 11. The principal surface coating portion 611 may be connected to the first intermediate layer 4 or may not be connected to the first intermediate layer 4. Unlike this embodiment, the principal surface coating portion 611 may not cover the entirety of the principal surface 11. Part of the principal surface 11 may be exposed from the principal surface coating portion 611.

The principal surface coating portion 612 covers the principal surface 12. In this embodiment, the principal surface coating portion 612 covers the entirety of the principal surface 12. As shown in FIG. 5, the principal surface coating portion 612 covers an end of the principal surface 12 which is on the opposite side from the second electrode 2 in the direction X. That is, the principal surface coating portion 612 covers the principal surface 12 in the neighborhood of the boundary between the principal surface 12 and the side surface 14. In this embodiment, the principal surface coating portion 612 covers the principal surface 12 from the end which is on the second electrode 2 side to the end on the opposite side from the second electrode 2 in the direction X. That is, the principal surface coating portion 612 covers the principal surface 12 from the neighborhood of the first intermediate layer 4 to the neighborhood of the boundary between the principal surface 11 and the side surface 14. The principal surface coating portion 612 covers the principal surface 112 from the boundary between one of the side surfaces 13 and the principal surface 12 to the boundary between the other one of the side surfaces 13 and the principal surface 12. The principal surface coating portion 612 may be connected to the first intermediate layer 4 or may not be connected to the first intermediate layer 4. Unlike this embodiment, the principal surface coating portion 612 may not cover the entirety of the principal surface 12. Part of the principal surface 12 may be exposed from the principal surface coating portion 612.

The principal surface coating portion 612 is made of the same material as that of the principal surface coating portion 611, because the principal surface coating portion 612 and the principal surface coating portion 611 are formed simultaneously. When the principal surface coating portion 611 and the principal surface coating portion 612 are not to be formed simultaneously, different materials may be used for the principal surface coating portion 611 and the principal surface coating portion 612. As shown in FIG. 1, in the state where the chip resistor 101 is mounted on the mount board 801, the principal surface coating portion 612 faces the mount board 801. The principal surface coating portion 612 is covered by the solder layer 802.

In this embodiment, the coating film 61 does not cover the side surfaces 13 or the side surface 14. Thus, all of the side surfaces 13 and the side surface 14 are exposed from the coating film 61.

The coating film 62 covers the second electrode 2. The material forming the coating film 62 has a higher absorptance of a laser beam of the above-described wavelength of λ1 than that of the material forming the second electrode 2.

Referring to FIG. 10, when the wavelength λ1 is 1.05 μm, Cu, Fe or Ni may be used as the material for the first electrode 1, and Sn or solder (mainly composed of Sn) may be used as the material for the coating film 62.

As shown in FIGS. 1, 6 and 9, the coating film 62 includes a principal surface coating portion 621 and a principal surface coating portion 622. For instance, the thickness of the coating film 62 is about 5 μm.

The principal surface coating portion 621 covers the principal surface 21. In this embodiment, the principal surface coating portion 621 covers the entirety of the principal surface 21. As shown in FIG. 4, the principal surface coating portion 621 covers the end of the principal surface 21 which is on the opposite side from the first electrode 1 in the direction X. That is, the principal surface coating portion 621 covers the principal surface 21 in the neighborhood of the boundary between the principal surface 21 and the side surface 24. In this embodiment, the principal surface coating portion 621 covers the principal surface 21 from the end which is on the first electrode 1 side to the end on the opposite side from the first electrode 1 in the direction X. That is, the principal surface coating portion 611 covers the principal surface 21 from the neighborhood of the second intermediate layer 5 to the neighborhood of the boundary between the principal surface 21 and the side surface 24. The principal surface coating portion 621 covers the principal surface 21 from the boundary between one of the side surfaces 23 and the principal surface 21 to the boundary between the other one of the side surfaces 23 and the principal surface 21. The principal surface coating portion 621 may be connected to the second intermediate layer 5 or may not be connected to the second intermediate layer 5. Unlike this embodiment, the principal surface coating portion 621 may not cover the entirety of the principal surface 21. Part of the principal surface 21 may be exposed from the principal surface coating portion 621.

The principal surface coating portion 622 covers the principal surface 22. In this embodiment, the principal surface coating portion 622 covers the entirety of the principal surface 22. As shown in FIG. 5, the principal surface coating portion 622 covers an end of the principal surface 22 which is on the opposite side from the first electrode 1 in the direction X. That is, the principal surface coating portion 622 covers the principal surface 22 in the neighborhood of the boundary between the principal surface 22 and the side surface 24. In this embodiment, the principal surface coating portion 622 covers the principal surface 22 from the end which is on the first electrode 1 side to the end on the opposite side from the first electrode 1 in the direction X. That is, the principal surface coating portion 622 covers the principal surface 22 from the neighborhood of the second intermediate layer 5 to the neighborhood of the boundary between the principal surface 21 and the side surface 24. The principal surface coating portion 622 covers the principal surface 22 from the boundary between one of the side surfaces 23 and the principal surface 22 to the boundary between the other one of the side surfaces 23 and the principal surface 22. Unlike this embodiment, the principal surface coating portion 622 may not cover the entirety of the principal surface 22. Part of the principal surface 22 may be exposed from the principal surface coating portion 622.

The principal surface coating portion 622 is made of the same material as that of the principal surface coating portion 621, because the principal surface coating portion 622 and the principal surface coating portion 621 are formed simultaneously. As shown in FIG. 1, in the state where the chip resistor 101 is mounted on the mount board 801, the principal surface coating portion 622 faces the mount board 801. The principal surface coating portion 622 is covered by the solder layer 802.

In this embodiment, the coating film 62 does not cover the side surfaces 23 or the side surface 24. Thus, all of the side surfaces 23 and the side surface 24 are exposed from the coating film 62.

As shown in FIG. 8, oxides 691 are present in the first electrode 1, the resistor portion 3 and the first intermediate layer 4. The oxides 691 are oxides of the materials forming the first electrode 1, the resistor portion 3 or the coating film 61. The oxides 691 present in the first electrode 1 may be oxides of the materials forming the first electrode 1 or the coating film 61. The oxides 691 present in the resistor portion 3 may be oxides of the material forming the resistor portion 3. The oxides 691 present in the first intermediate layer 4 are oxides of the material forming the first electrode 1, the material forming the resistor portion 3 or the material forming the coating film 61. Depending on the manufacturing conditions of the chip resistor 101, the oxides 691 may not be formed in the first electrode 1 or the resistor portion 3. The oxides 691 are schematically illustrated In FIG. 8 and do not actually exist in the form of a plurality of particles.

As shown in FIG. 9, the oxides 692 are present in the second electrode 2, the resistor portion 3 and the second intermediate layer 5. The oxides 692 are oxides of the materials forming the second electrode 2, the resistor portion 3 or the coating film 62. The oxides 692 present in the second electrode 2 may be oxides of the materials forming the second electrode 2 or the coating film 62. The oxides 692 present in the resistor portion 3 may be oxides of the material forming the resistor portion 3. The oxides 692 present in the second intermediate layer 5 are oxides of the material forming the second electrode 2, the material forming the resistor portion 3 or the material forming the coating film 62. Depending on the manufacturing conditions of the chip resistor 101, the oxides 692 may not be formed in the second electrode 2 or the resistor portion 3. The oxides 692 are schematically illustrated In FIG. 9 and do not actually exist in the form of a plurality of particles.

A method for manufacturing the chip resistor 101 is described below.

Figure 11:
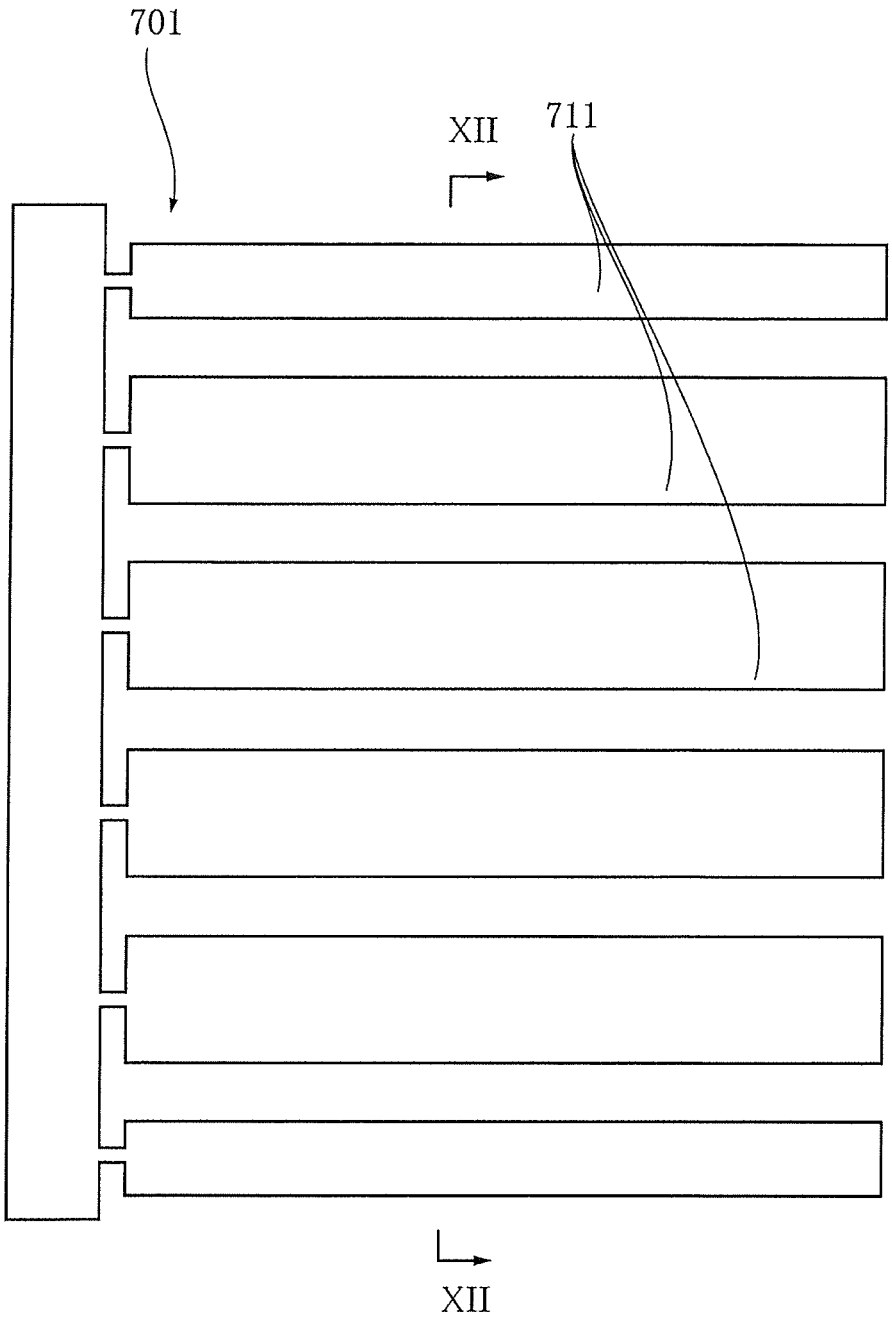
FIG. 11 is a plan view showing a step of a method for manufacturing the chip resistor according to the first embodiment of the present invention.
Figure 12:
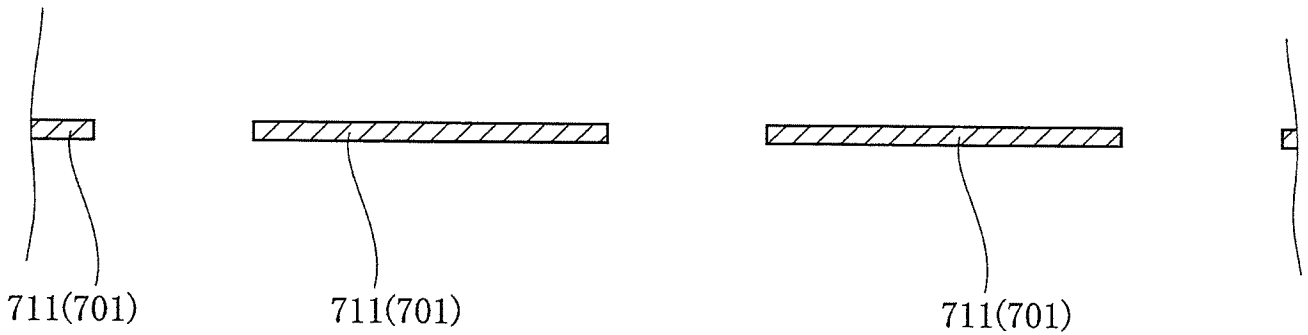
FIG. 12 is a schematic sectional view taken along lines XII-XII in FIG. 11.

First, as shown in FIGS. 11 and 12, an electrically conductive member 701 is prepared. The electrically conductive member 701 is a lead frame in this embodiment and includes at least three conductive elongated boards 711. In the illustrated example, the electrically conductive member 701 includes six conductive elongated boards 711. The conductive elongated boards 711 are elongated in one direction. In the electrically conductive member 701, the conductive elongated boards 711 are spaced apart from each other in the width direction crossing the longitudinal direction of one of the conductive elongated boards 711. As shown in FIG. 12, each conductive elongated board 711 is in the form of an elongated rectangle in cross section. In this embodiment, at least three conductive elongated boards 711 spaced apart from each other are provided by forming the electrically conductive member 701.

Figure 13:
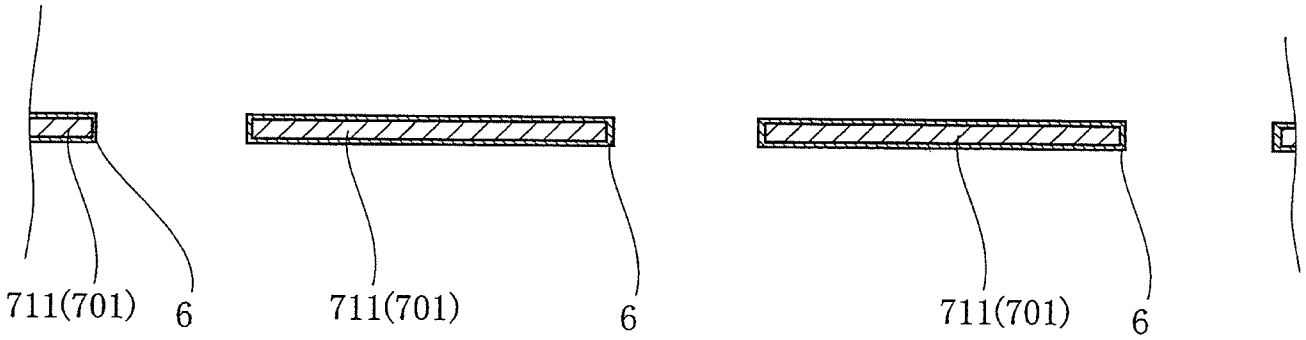
FIG. 13 is a schematic sectional view showing a step subsequent to the step of FIG. 12.

Then, as shown in FIG. 13, a coating film 6 is formed on the electrically conductive member 701. The coating film 6 later becomes the coating film 61 or the coating film 62. For instance, the coating film 6 is formed by plating. The coating film 6 may be formed after the lead frame is formed or before the lead frame is formed.

Figure 14:
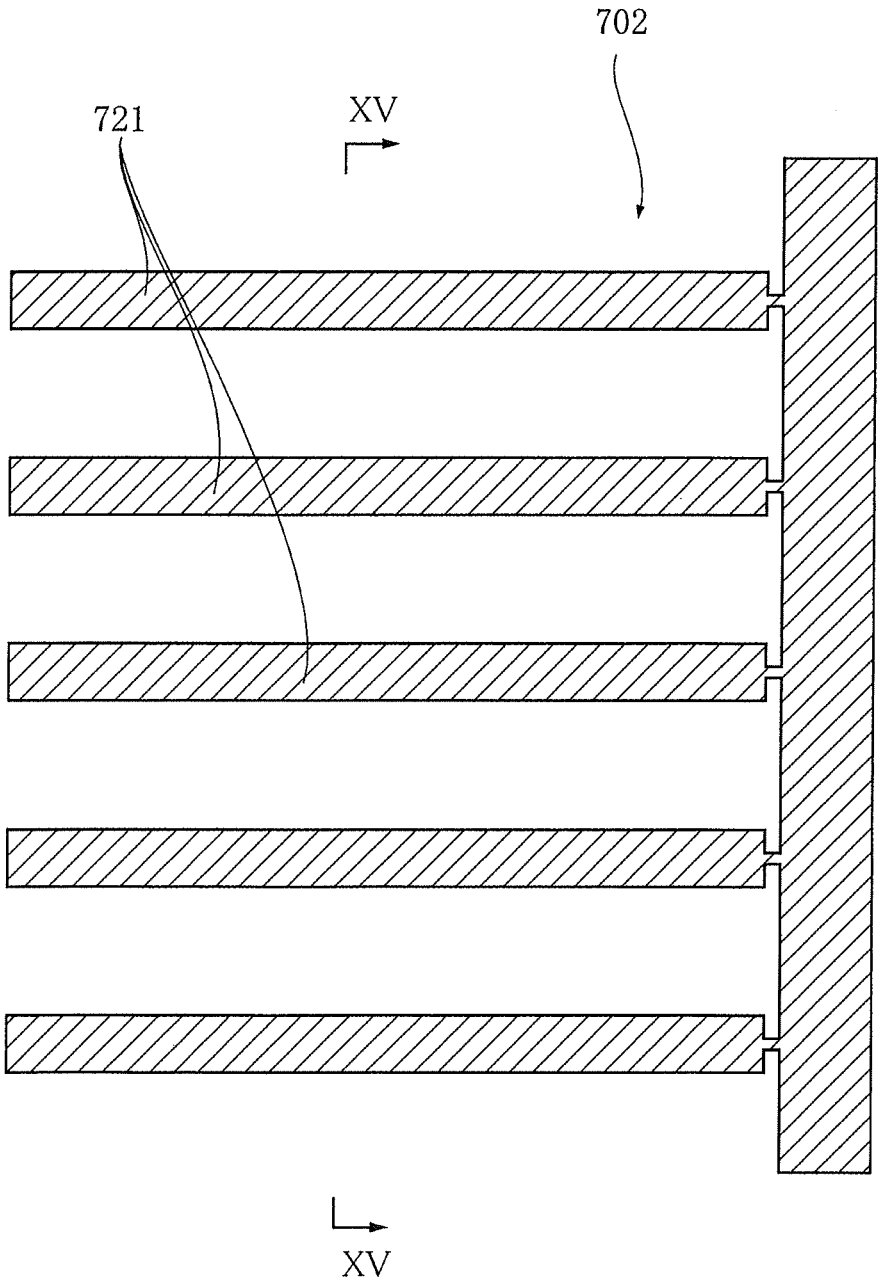
FIG. 14 is a plan view showing a step of a method for manufacturing the chip resistor according to the first embodiment of the present invention.
Figure 15:
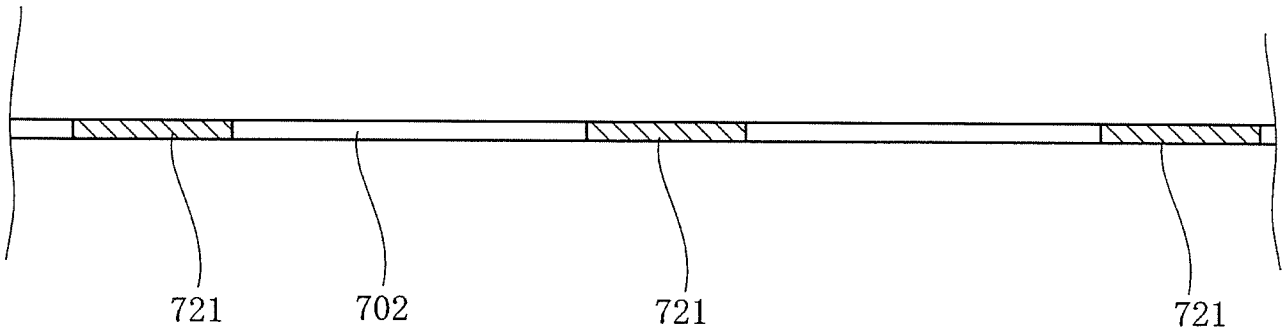
FIG. 15 is a schematic sectional view taken along lines XV-XV in FIG. 14.

Similarly, as shown in FIGS. 14 and 15, a resistive member 702 is prepared. In this embodiment, the resistive member 702 is a resistive frame and includes a plurality of resistive elongated boards 721. In the illustrated example, the resistive member 702 includes five resistive elongated boards 721. The resistive elongated boards 721 are elongated in one direction. In the resistive member 702, the resistive elongated boards 721 are spaced apart from each other in the width direction crossing the longitudinal direction of the resistive elongated boards 721. As shown in FIG. 15, each resistive elongated board 721 is in the form of an elongated rectangle in cross section. In FIG. 14, the resistive member 702 is hatched for easier understanding. This holds true for the subsequent plan views for explaining the chip resistor manufacturing method. Unlike this embodiment, the resistive member 702 may be a single flat plate large enough to cover collectively all the conductive elongated boards 711 as viewed in plan.

Figure 16:
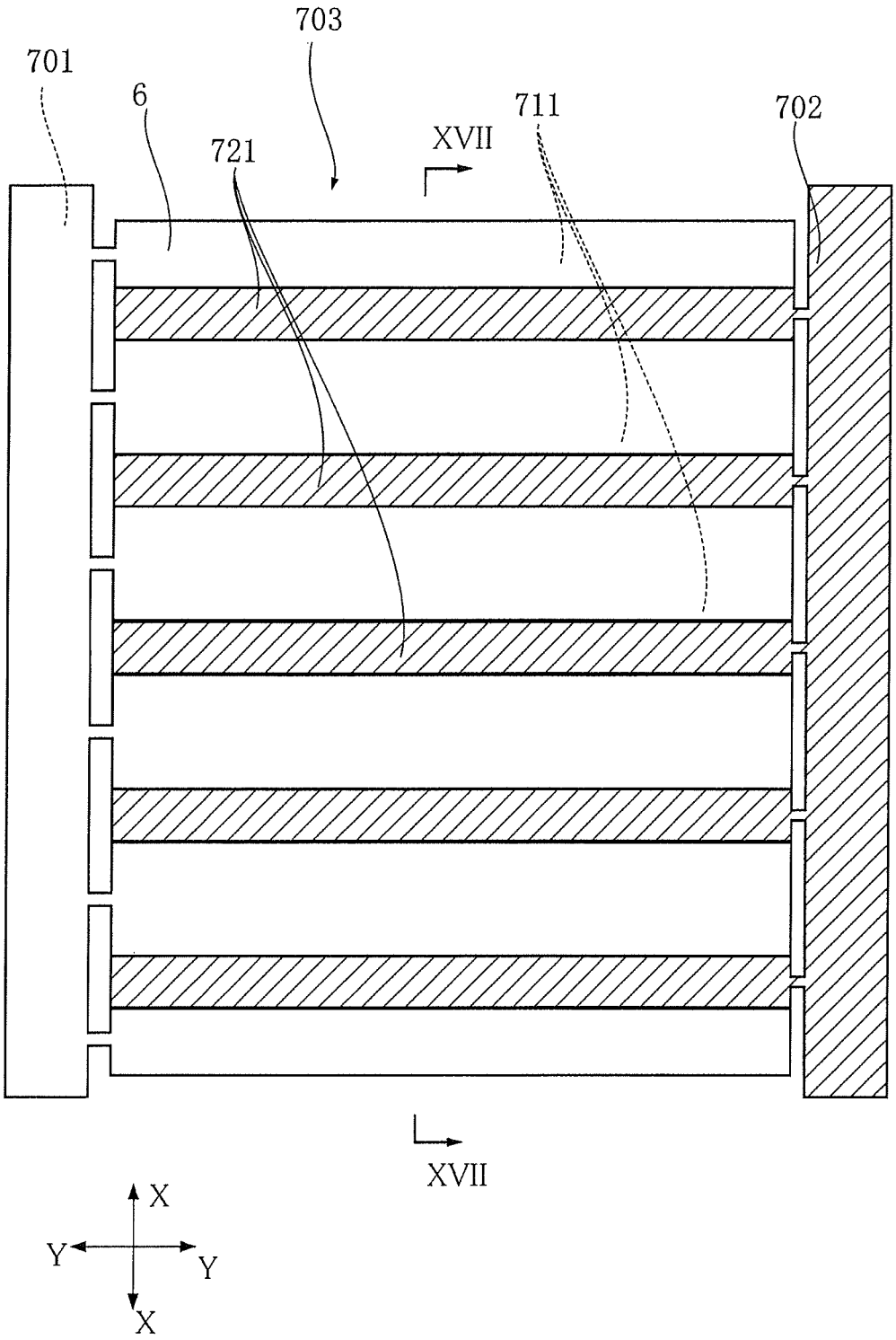
FIG. 16 is a plan view showing a step of a method for manufacturing the chip resistor according to the first embodiment of the present invention.
Figure 17:
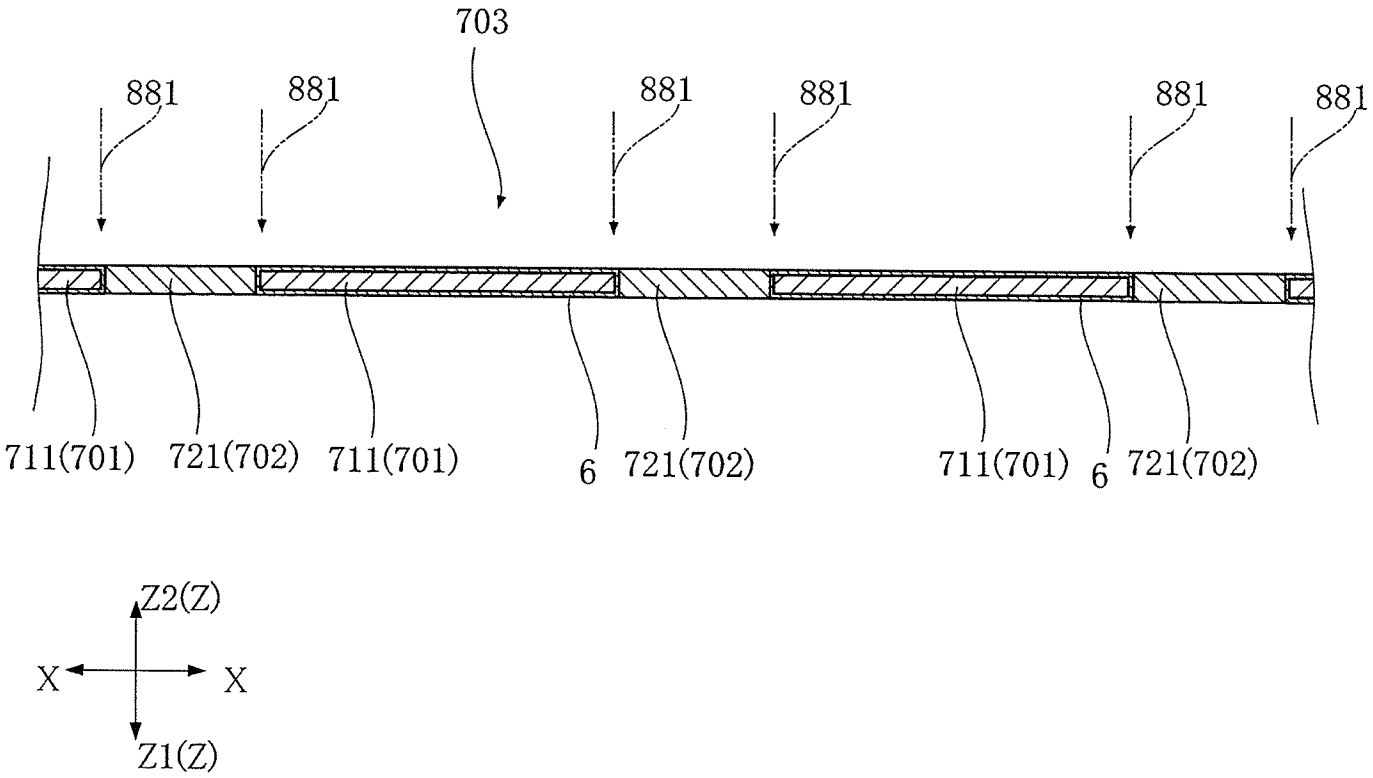
FIG. 17 is a schematic sectional view taken along lines XVII-XVII in FIG. 16.

Then, as shown in FIGS. 16 and 17, the electrically conductive member 701 and the resistive member 702 are bonded together, whereby a resistor aggregate 703 is provided. To form the resistor aggregate 703, the resistive member 702 is bonded to at least three conductive elongated boards 711 of the electrically conductive member 701. In this embodiment, each of the resistive elongated boards 721 is bonded to adjacent two of at least three conductive elongated boards 711. In this process, each of the resistive elongated boards 721 is arranged between adjacent two of at least three conductive elongated boards 711.

Laser is used to bond the conductive elongated boards 711 and the resistive member 702. For instance, as shown in FIG. 17, welding laser beams 881 are applied in the direction Z1 to the gaps between the conductive elongated boards 711 and the resistive elongated boards 721. For the welding laser beams 881, fiber laser technology can be used. However, the welding laser beams 881 are not limited to those by fiber laser technology. Fiber laser technology is suitable for producing a large-output laser beam by using a compact oscillator. The wavelength of the welding laser beams 881 used in this embodiment is the above-described wavelength $\lambda 1$, which is 1.05 μm. Since the electrically conductive member 701 (i.e., the conductive elongated board 711) is covered by the coating film 6 as described above, the welding laser beams 881 impinge on the coating film 6 before impinging on the electrically conductive member 701. When the welding laser beams 881 impinge on the coating film 6, the coating film 6 melts, whereby the electrically conductive member 701 is exposed from the coating film 6. After the electrically conductive member 701 is exposed from the coating film 6, the welding laser beams 881 directly impinge on the electrically conductive member 701. Since the welding laser beams 881 melt the electrically conductive member 701 (conductive elongated board 711) and the resistive member 702, the electrically conductive member 701 (conductive elongated board 711) and the resistive member 702 are bonded together. The molten portions of the electrically conductive member 701, the resistive member 702 and the coating film 6 solidify, whereby the portions to become the first intermediate layer 4 or the second intermediate layer 5 shown in FIG. 1 are formed.

Since laser is used to bond the electrically conductive member 701 and the resistive member 702, the bonding is performed not in vacuum but in the air, which contains a lot of oxygen. Thus, when the coating film 61, the first electrode 1 or the resistor portion 3 melts due to the application of welding laser beams 881 (or before or after the melting), oxides of the materials forming the coating film 61, the first electrode 1 or the resistor portion 3 are formed. The oxides are the above-described oxides 691. The oxides 692 are formed in the same way.

Figure 18:
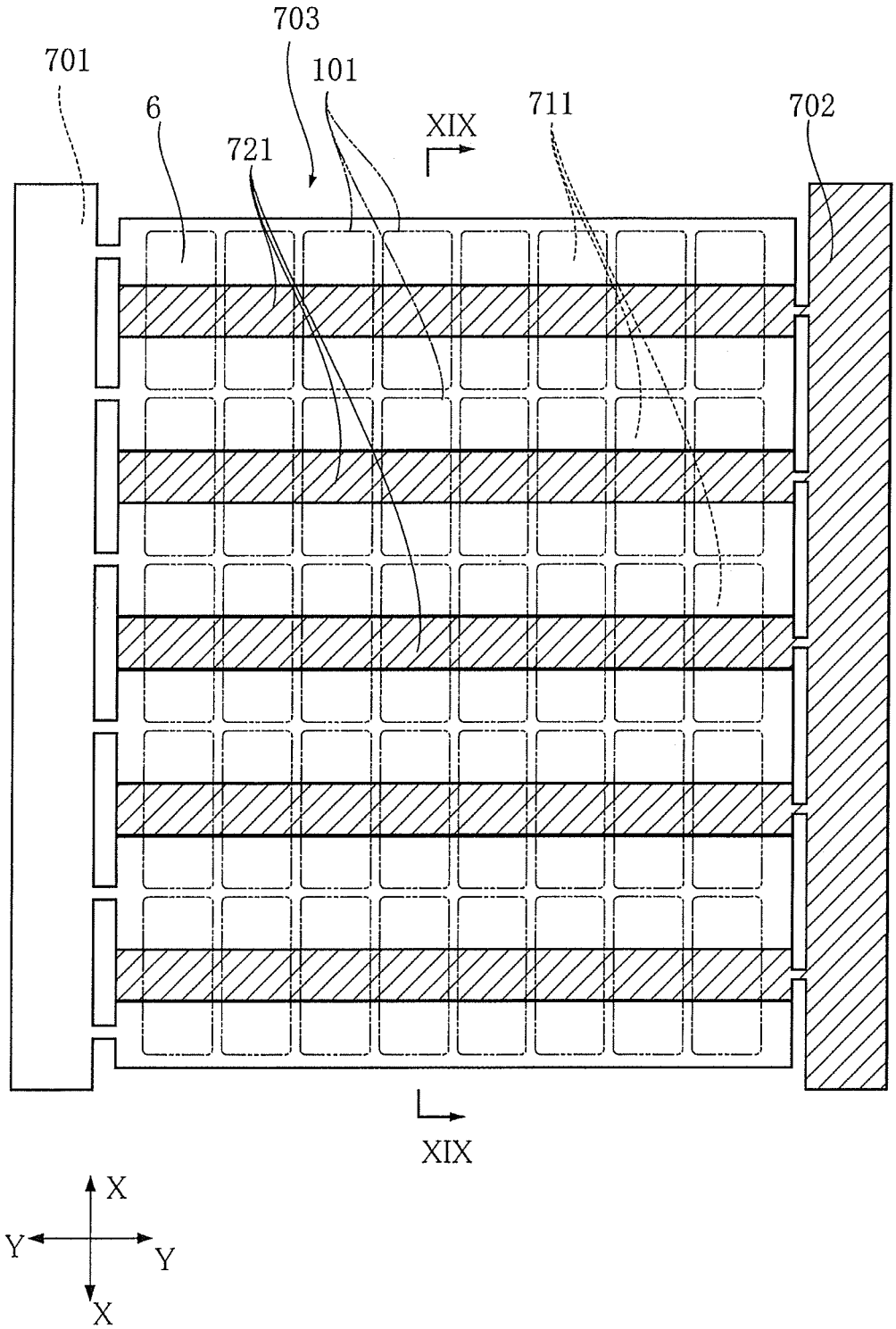
FIG. 18 is a plan view showing a step subsequent to FIG. 16.
Figure 19:
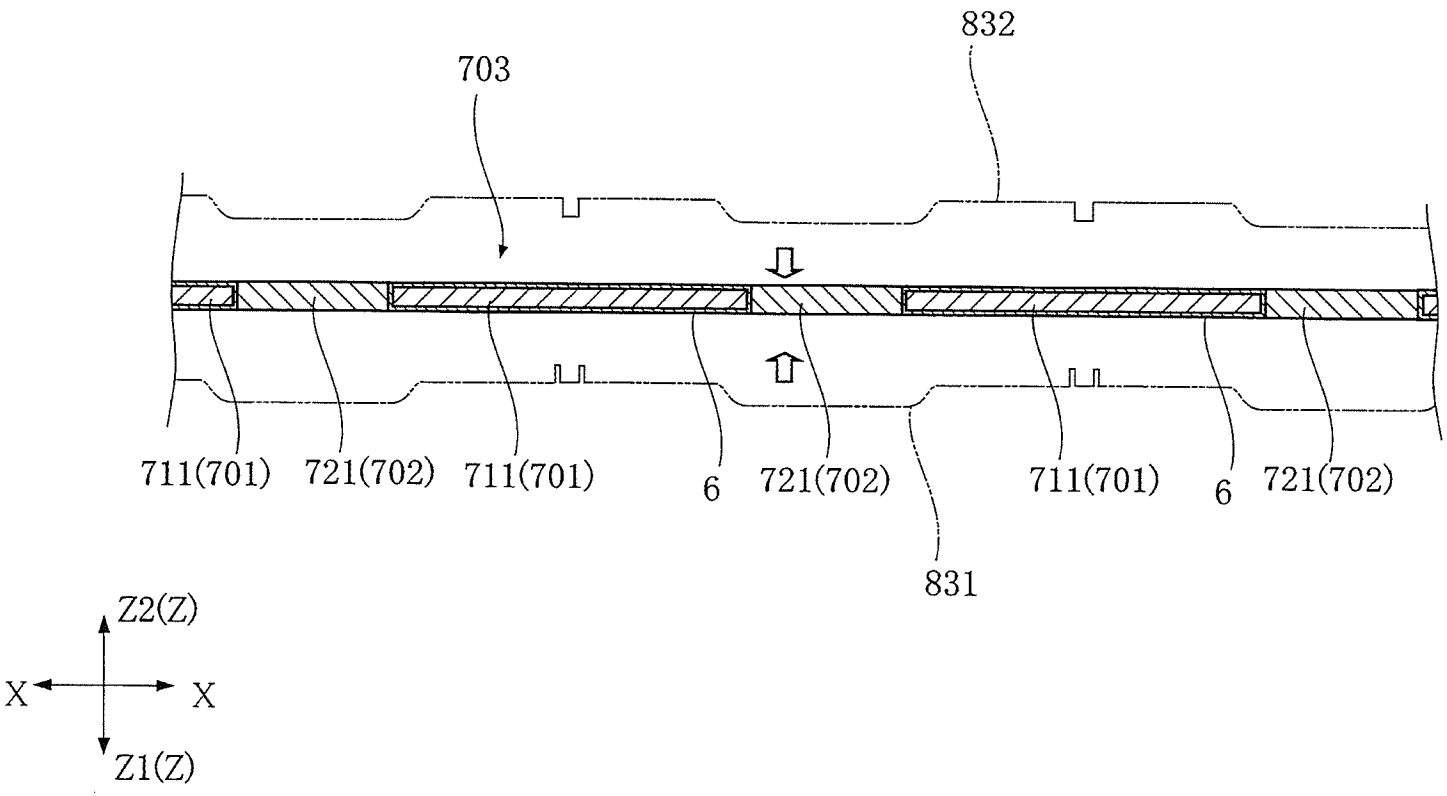
FIG. 19 is a schematic sectional view taken along lines XIX-XIX in FIG. 18.
Figure 20:
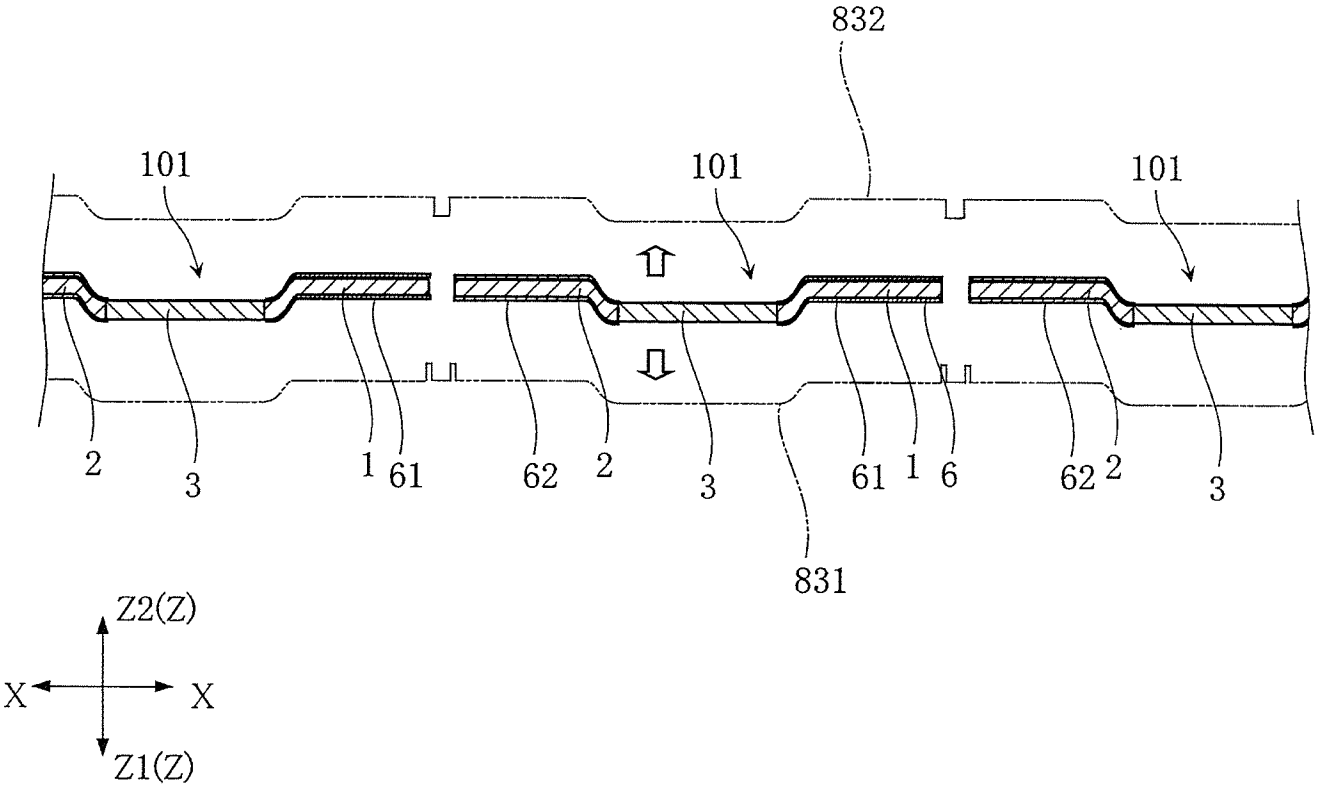
FIG. 20 is a schematic sectional view showing a step subsequent to the step of FIG. 19.

Then, as shown in FIGS. 18-20, the resistor aggregate 703 is collectively divided into a plurality of chip resistors 101. In FIG. 18, each of the regions of the resistor aggregate 703 which are to become chip resistors 101 is indicated by a double-dashed line. For instance, about 40 chip resistors 101 are obtained from a single resistor aggregate 703. To divide the resistor aggregate 703 into a plurality of chip resistors 101, two punching dies 831, 832 (see FIG. 19) of a size corresponding to the plurality of chip resistors as viewed in plan are used. By pressing the resistor aggregate 703 between the punching die 831 and the punching die 832, the resistor aggregate 703 is punched. By punching the resistor aggregate 703, the curved surfaces 15 of the first electrode 1 or the curved surfaces 25 of the second electrode 2 may be formed.

As shown in FIG. 20, at the same time as the step of punching the resistor aggregate 703 is performed, the step of bending one of the conductive elongated boards 711 is performed. In this embodiment, each conductive elongated board 711 is bent so that portions of the first electrode 1 and the second electrode 2 which are relatively close to the resistor portion 3 are shifted toward the direction Z1, or the direction in which the welding laser beams 881 travel, from the portions of the first electrode 1 and the second electrode 2 which are relatively far from the resistor portion 3. In this way, a plurality of chip resistors 101 are manufactured.

The advantages of this embodiment are described below.

In the case where the electrically conductive member 701 and the resistive member 702 are to be bonded to each other by using an electron beam, the electrically conductive member 701 and the resistive member 702 need to be placed in a vacuum chamber. In this embodiment, the electrically conductive member 701 and the resistive member 702 are bonded to each other by using welding laser beams 881. Laser beam welding can be performed at an atmospheric pressure and does not need to be performed in vacuum. Thus, welding can be performed without the need for putting the electrically conductive member 701 and the resistive member 702 in a vacuum chamber or evacuating the vacuum chamber. In this way, the method according to the present invention, which uses welding laser beams 881, can omit troublesome works related to welding in vacuum. Thus, the method according to this embodiment is suitable for enhancing the manufacturing efficiency of the chip resistor 101.

In this embodiment, the material forming the coating film 6 has a higher absorptance of a laser beam of the above-described wavelength of $\lambda 1$ than that of the material forming the electrically conductive member 701. In the step of bonding the electrically conductive member 701 and the resistive member 702, the welding laser beams 881 having the wavelength $\lambda 1$ is applied to the coating film 6. In this arrangement, when the welding laser beams 881 are applied to the coating film 6, a large amount of heat is generated at the coating film 6. Part of the heat generated at the coating film 6 is used to melt the coating film 6. Meanwhile, part of the heat generated at the coating film 6 is conducted to the electrically conductive member 701. The heat conducted from the coating film 6 to the electrically conductive member 701 is used to melt the electrically conductive member 701. Thus, the electrically conductive member 701 starts to melt quickly, so that the time taken for the bonding of the electrically conductive member 701 and the resistive member 702 shortens. Alternatively, instead of shortening the time taken for the bonding of the electrically conductive member 701 and the resistive member 702, the energy of the welding laser beams 881 can be lowered. Alternatively, the time taken for the bonding of the electrically conductive member 701 and the resistive member 702 can be shortened, while the energy of the welding laser 881 is lowered. Thus, the method according to this embodiment is suitable for enhancing the manufacturing efficiency of the chip resistor 101.

In this embodiment, the coating film 61 and the coating film 62 are made of Sn or solder. The coating film 61 includes the principal surface coating portion 612. The principal surface coating portion 612 covers the end of the principal surface 12 which is on the opposite side from the second electrode 2 in the direction X. Both of Sn and solder have high solder wettability. Thus, the principal surface coating portion 612 and the solder layer 802 are strongly bonded to each other, so that the chip resistor 101 is strongly bonded to the mount board 801. Similarly, the coating film 62 includes the principal surface coating portion 622. The principal surface coating portion 622 covers the end of the principal surface 22 which is on the opposite side from the first electrode 1 in the direction X. Thus, the principal surface coating portion 622 and the solder layer 802 are strongly bonded to each other, so that the principal surface coating portion 622 is strongly bonded to the mount board 801.

In this embodiment, the coating film 61 includes the principal surface coating portion 611. The principal surface coating portion 611 covers the principal surface 11. This arrangement prevents the principal surface 11 from oxidizing or changing in color. Also, the coating film 62 covers the principal surface coating portion 621. The principal surface coating portion 621 covers the principal surface 21. This arrangement prevents the principal surface 21 from oxidizing or changing in color.

According to the embodiment, the resistor aggregate 703 is formed by bonding the resistive member 702 to at least three conductive elongated boards 711. With this arrangement, the number of chip resistors 101 obtained per unit length in the direction Y shown in FIG. 18 increases. In this embodiment, the resistor aggregate 703 is collectively divided by punching into a plurality of chip resistors 101. Thus, it is not necessary to successively cut the chip resistors 101. This enhances the manufacturing efficiency of the chip resistors 101. Thus, the method according to this embodiment is suitable for efficiently manufacturing the chip resistor 101.

Since the chip resistor 101 is manufactured by punching, the dimensional accuracy of the chip resistor 101 as viewed in plan is determined by the dimensional accuracy of the punching dies 831, 832. Accordingly, the dimensional accuracy of the resistor portion 3 of the chip resistor 101 in the direction Y is also determined by the dimensional accuracy of the punching dies 831, 832. According to the method of this embodiment, by selecting punching dies 831, 832 of a desired dimensional accuracy before punching the resistor aggregate 703, the dimensional error in the direction Y of the resistor portions 3 is reduced as compared with the conventional method of successively cutting the strips. When the dimensional error in the direction Y of the resistor portions 3 is reduced, a larger number of resistor portions 3 having a desired resistance are obtained, whereby a larger number of chip resistors 101 having a desired resistance are obtained. When the chip resistor 101 has a desired resistance, the trimming process for adjusting the resistance of the chip resistor 101 does not need to be performed. In this way, the number of chip resistors 101 which require trimming process reduces. This leads to enhancement of the manufacturing efficiency of the chip resistor 101.

In this embodiment, a lead frame is used as the electrically conductive member 701, and a resistive frame is used as the resistive member 702. Thus, it is not necessary to individually hold a plurality of conductive elongated boards 711 or a plurality of resistive elongated boards 721, which facilitates handling.

Unlike the conventional method for manufacturing a chip resistor, this embodiment does not use a reel. Thus, the work of winding a strip of a resistive material or an electrically conductive material around a reel is not necessary. Thus, the use of a large apparatus for winding a strip around a reel is also unnecessary. Since pulling the strip out of the reel is not necessary, the use of a large apparatus for pulling the strip out of the reel is also unnecessary.

When a reel is used to manufacture a chip resistor, the entire production line is stopped if a trouble happens at some point of a strip. Since this embodiment does not use a reel, such a problem does not occur.

In this embodiment, welding laser beams 881 are applied along the direction Z1. According to this arrangement, the conductive elongated board 711 and the resistive elongated board 721 are more likely to absorb the energy of the high energy beams on the direction Z2 side and hence relatively easily melt on this side. As a result, the wide portion 43 exposed in the direction Z2 is formed in the first intermediate layer 4 of the chip resistor 101. Burrs (not shown) may be formed on the surface of the wide portion 43. In this embodiment, each of the conductive elongated board 711 is bent so that the portion of the first electrode 1 or the second electrode 2 which is close to the resistor portion 3 is deviated toward the direction Z1 side from the portion of the first electrode 1 or the second electrode 2 which is distant from the resistor portion 3. According to this arrangement, even when burrs are formed on the surface of the wide portion 43, the burrs are in the recessed portion of the chip resistor 101 and not on the direction z1 side of the chip resistor 101. Thus, when the chip resistor 101 is held by a holder (not shown) for movement, the holder does not come into contact with the burrs. This allows the chip resistor 101 to be moved stably.

Variations of the foregoing embodiment and other embodiments are described below. In the description given below, the elements that are identical or similar to those of the foregoing embodiments are designated by the same reference signs as those used for the foregoing embodiment, and the explanation is omitted appropriately.

<The First Variation of the First Embodiment>

Figure 23:
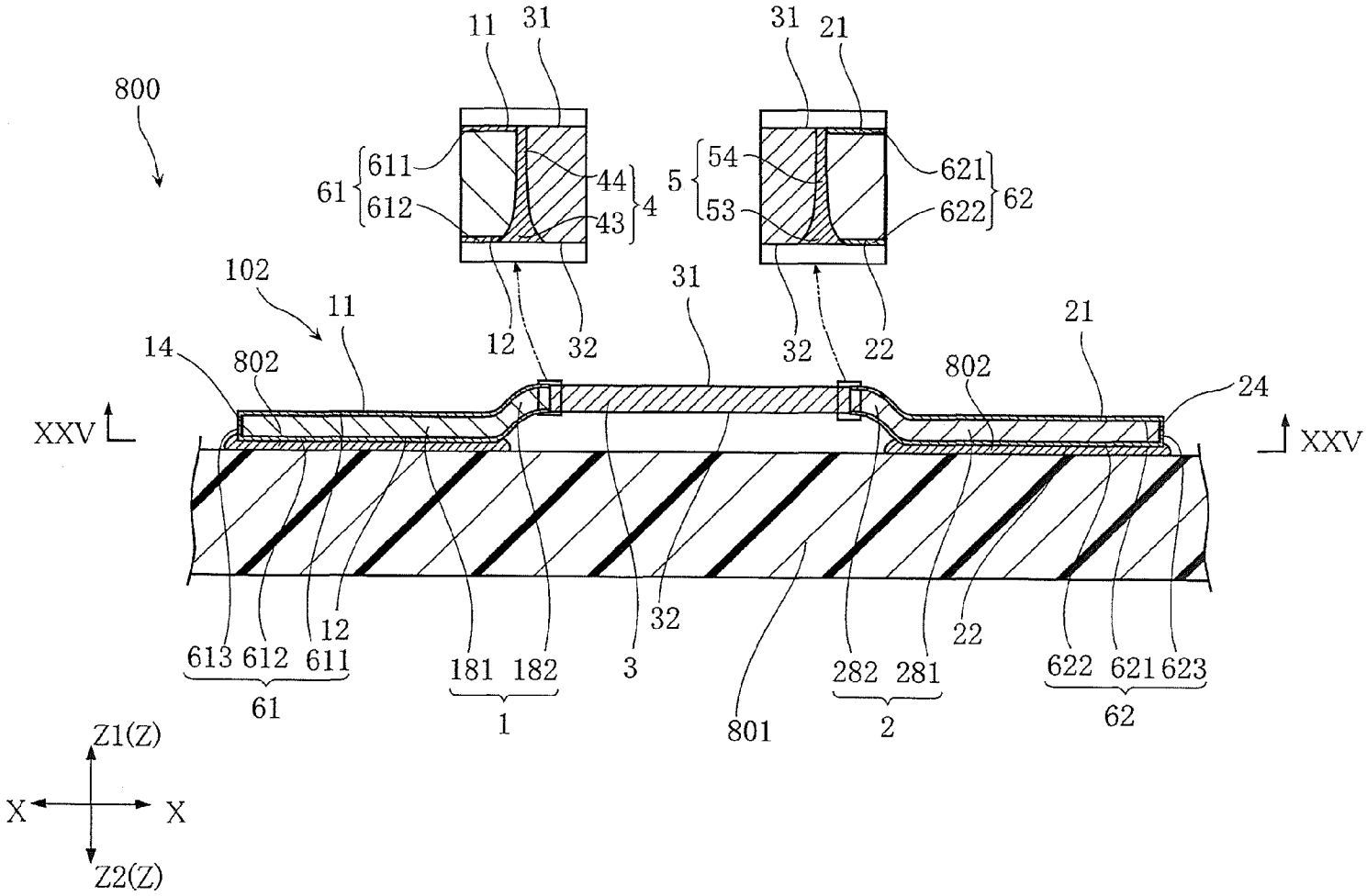
FIG. 23 is a sectional view of a first variation of the chip resistor mount structure according to the first embodiment of the present invention.
Figure 24:
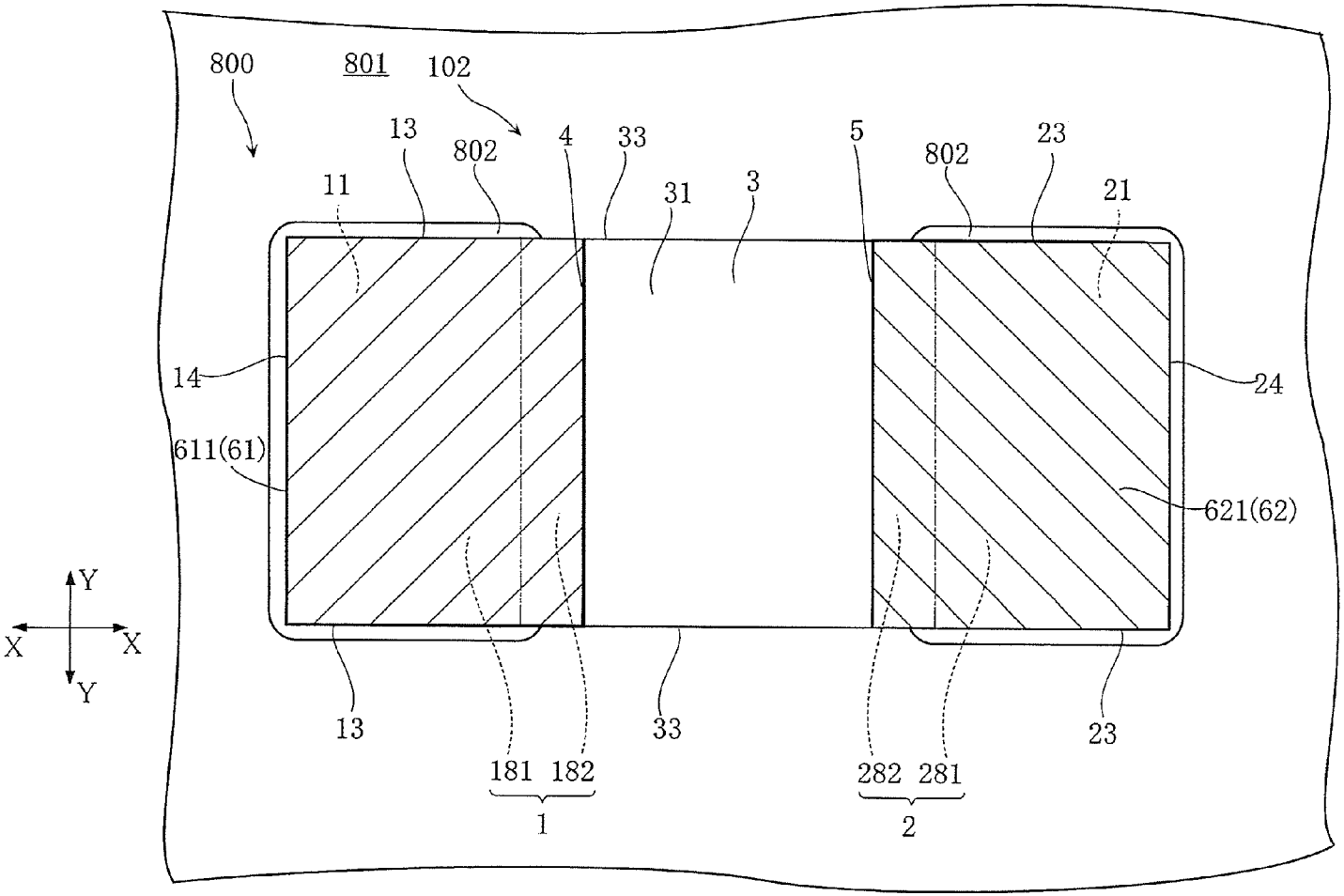
FIG. 24 is a plan view of the mount structure of the chip resistor shown in FIG. 23.
Figure 25:
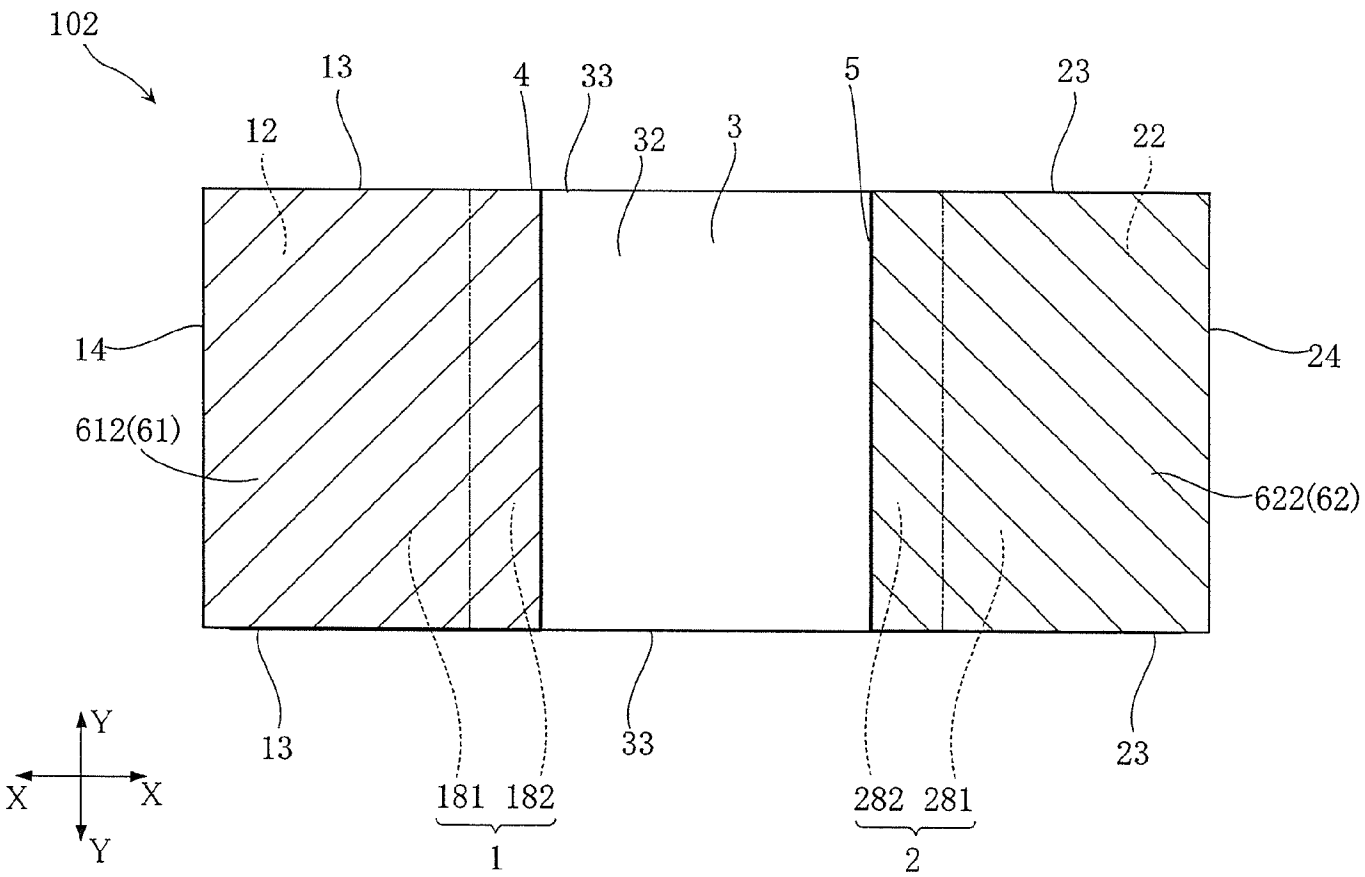
FIG. 25 is a view (partially omitted) along lines XXV-XXV in FIG. 23.
Figure 26:
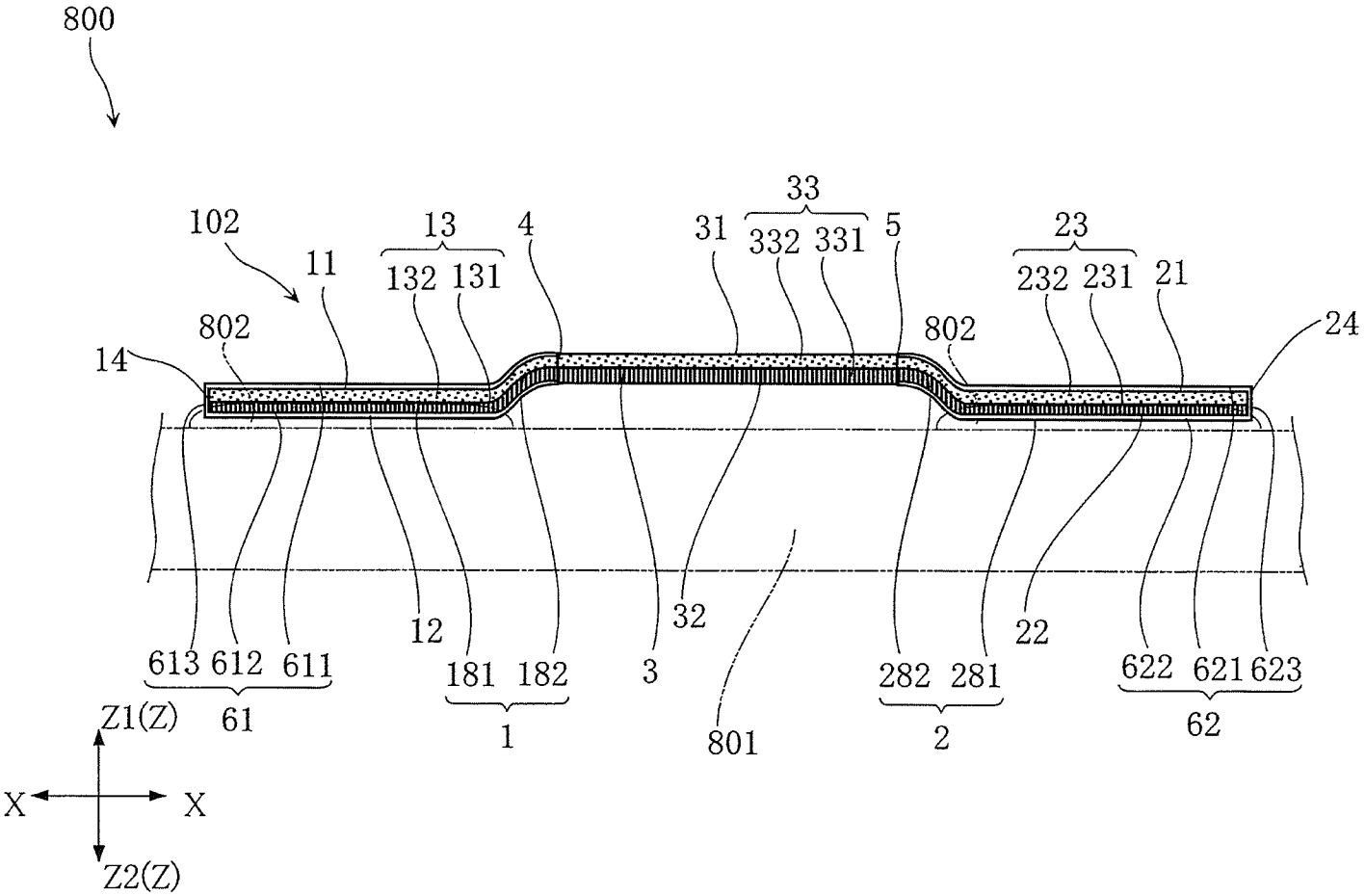
FIG. 26 is a front view of the chip resistor shown in FIG. 23.

FIG. 23 is a sectional view of a mount structure of a chip resistor according to the first variation of the first embodiment of the present invention. FIG. 24 is a plan view of the mount structure of a chip register in FIG. 23. FIG. 25 is a view (partially omitted) along lines XXV-XXV in FIG. 23. FIG. 26 is a front view of the chip resistor in FIG. 23.

The chip resistor 102 of this variation includes a first electrode 1, a second electrode 2, a resistor portion 3, a first intermediate layer, a second intermediate layer 5, a coating film 61, a coating film 62, oxides 691 (not shown in this variation, see FIG. 8) and oxides 692 (not shown in this variation, see FIG. 9). In this variation, the structures of the resistor portion 3, the first intermediate layer 4, the second intermediate layer 5 and the oxides 691, 692 are the same as those of the chip resistor 101, so that explanation of these elements are omitted.

The first electrode 1 includes a principal surface 11 (second principal surface), a principal surface 12 (first principal surface), two side surfaces 13 (first side surfaces) and a side surface 14 (second side surface), but does not include a curved surface 15. The first electrode 1 of this variation is the same as that of the above-described chip resistor 101 except that the first electrode 1 of this variation does not include a curved surfaces 15 and except the structure of the side surface 14, which is described later.

The side surface 14 is covered by the coating film 61. Unlike the foregoing embodiment, the side surface 14 of this variation does not include the line-trace formed surface 141 or the breakage-trace formed surface 142. The side surface 14 is flat.

The second electrode 2 includes a principal surface 21, a principal surface 22, two side surfaces 23 and a side surface 24 but does not include a curved surface 25. The second electrode 2 of this variation is the same as that of the above-described chip resistor 101 except that the second electrode 2 of this variation does not include a curved surface 25 and except the structure of the side surface 24, which is described later.

The side surface 24 is covered by the coating film 62. Unlike the foregoing embodiment, the side surface 24 of this variation does not include the line-trace formed surface 241 or the breakage-trace formed surface 242. The side surface 24 is flat.

Figure 27:
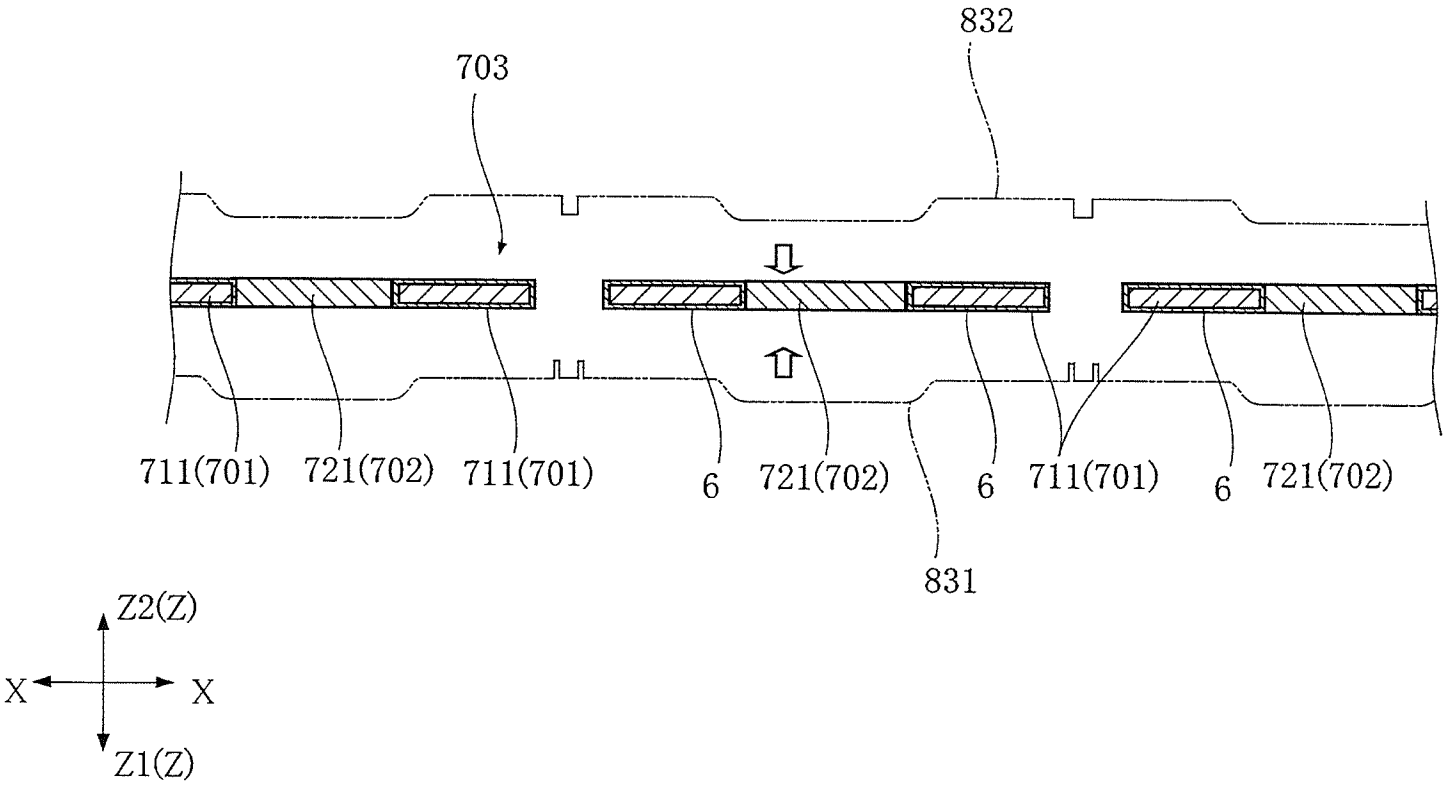
FIG. 27 is a schematic sectional view showing a step of a method for manufacturing the chip resistor according to the first variation of the first embodiment of the present invention.

The coating film 61 has the same structure as that of the coating film 61 of the chip resistor 101 of the foregoing embodiment except that the coating film of this variation further includes a side surface coating portion 613. The side surface coating portion 613 covers the side surface 14. The side surface coating portion 613 is connected to both of the principal surface coating portion 611 and the principal surface coating portion 612. As shown in FIG. 27, in manufacturing the chip resistor 102, the punching die 831 and the punching die 832 are superimposed at the gaps between each conductive elongated board 711 and the adjacent conductive elongated board 711. Thus, even after the punching is performed by the punching die 831 and the punching die 832, the coating film 6 remains on the side surface of the conductive elongated board 711. This is why the coating film 61 has the side surface coating portion 613. This holds true for the side surface coating portion 623.

The coating film 62 has the same structure as that of the coating film 62 of the chip resistor 101 of the foregoing embodiment except that the coating film of this variation further includes a side surface coating portion 623. The side surface coating portion 623 covers the side surface 24. The side surface coating portion 623 is connected to both of the principal surface coating portion 621 and the principal surface coating portion 622.

According to this variation, the same advantages as those of the chip resistor 101 are obtained.

In the chip resistor 102, the coating film 61 includes the side surface coating portion 613. The side surface coating portion 613 is made of a material having high solder wettability. Thus, the side surface coating portion 613 and the solder layer 802 are strongly bonded to each other, so that the chip resistor 102 is strongly bonded to the mount board 801. In the chip resistor 102, the coating film 62 includes the side surface coating portion 623. The side surface coating portion 623 is made of a material having high solder wettability. Thus, the principal surface coating portion 623 and the solder layer 802 are strongly bonded to each other, so that the chip resistor 102 is strongly bonded to the mount board 801.

<Another Variation of the First Embodiment>

Figure 28:
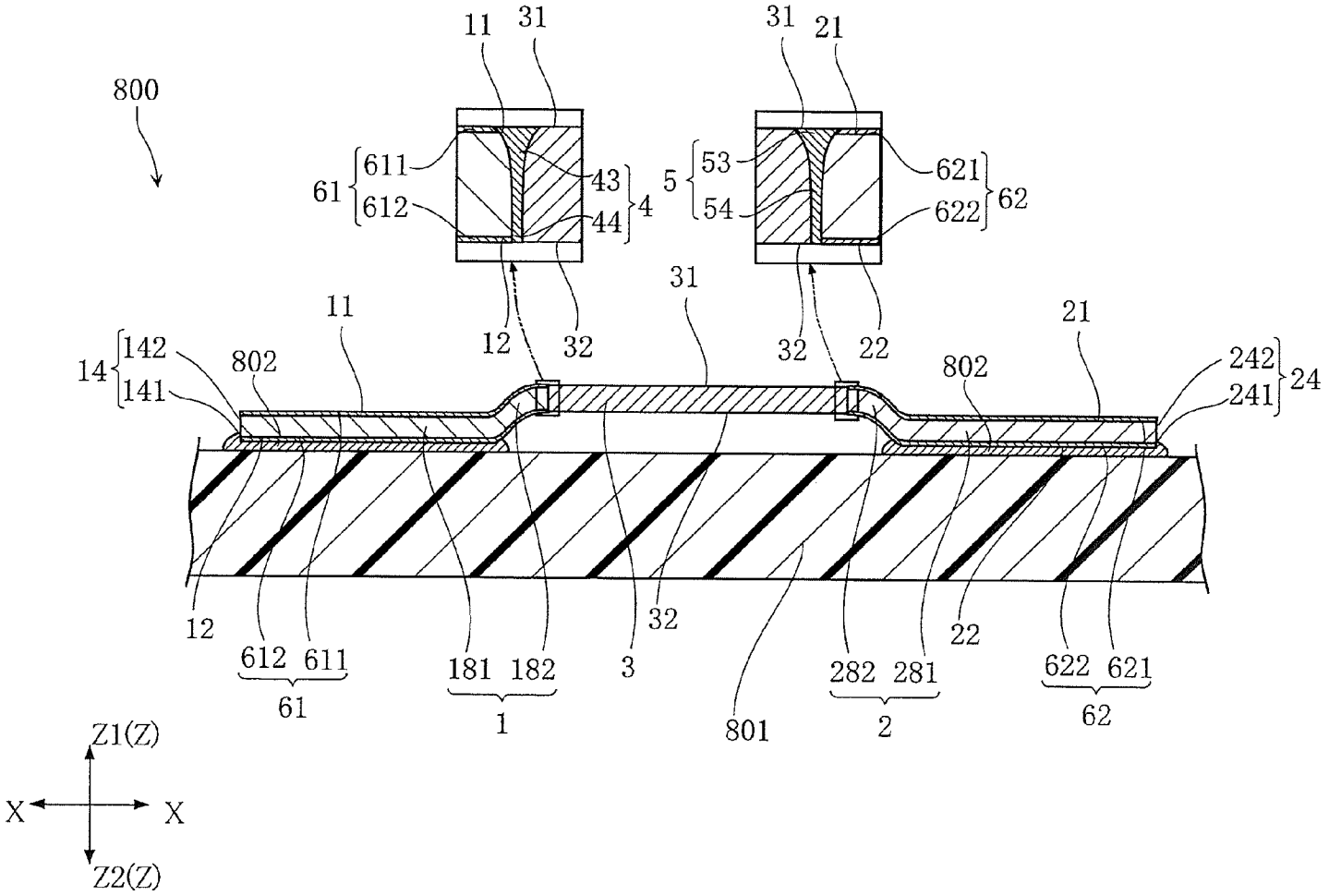
FIG. 28 is a sectional view of a mount structure of a chip resistor according to another variation of the first embodiment of the present invention.

The welding laser beams 881 (see FIG. 17) may not be applied in the direction Z1 but may be applied in the direction Z2. In this case, as shown in FIG. 28, the vertical direction of the first intermediate layer 4 and the second intermediate layer 5 is reversed to that shown in FIG. 1.

Second Embodiment

Figure 29:
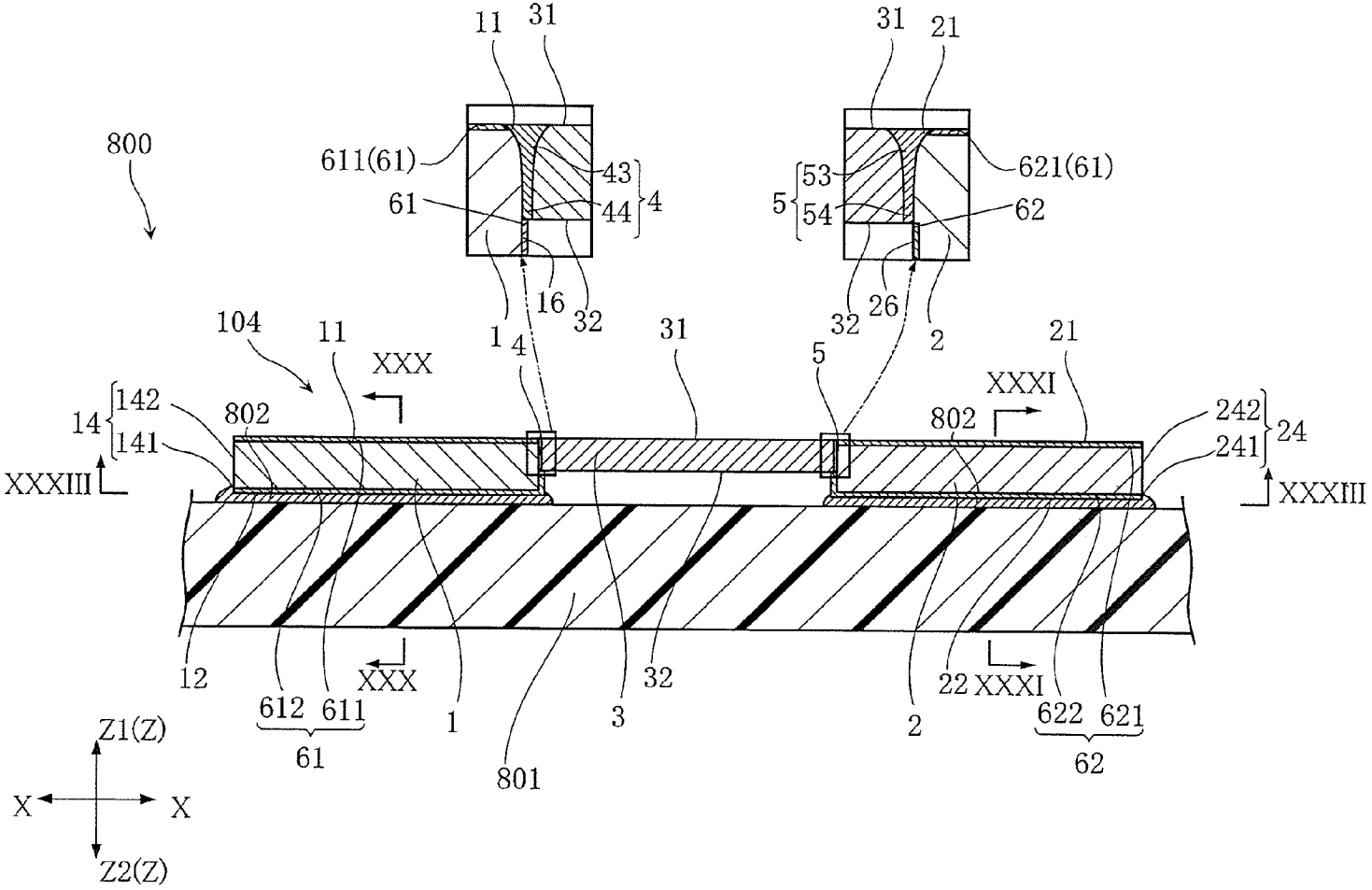
FIG. 29 is a sectional view of a mount structure of a chip resistor according to a second embodiment of the present invention.
Figure 30:
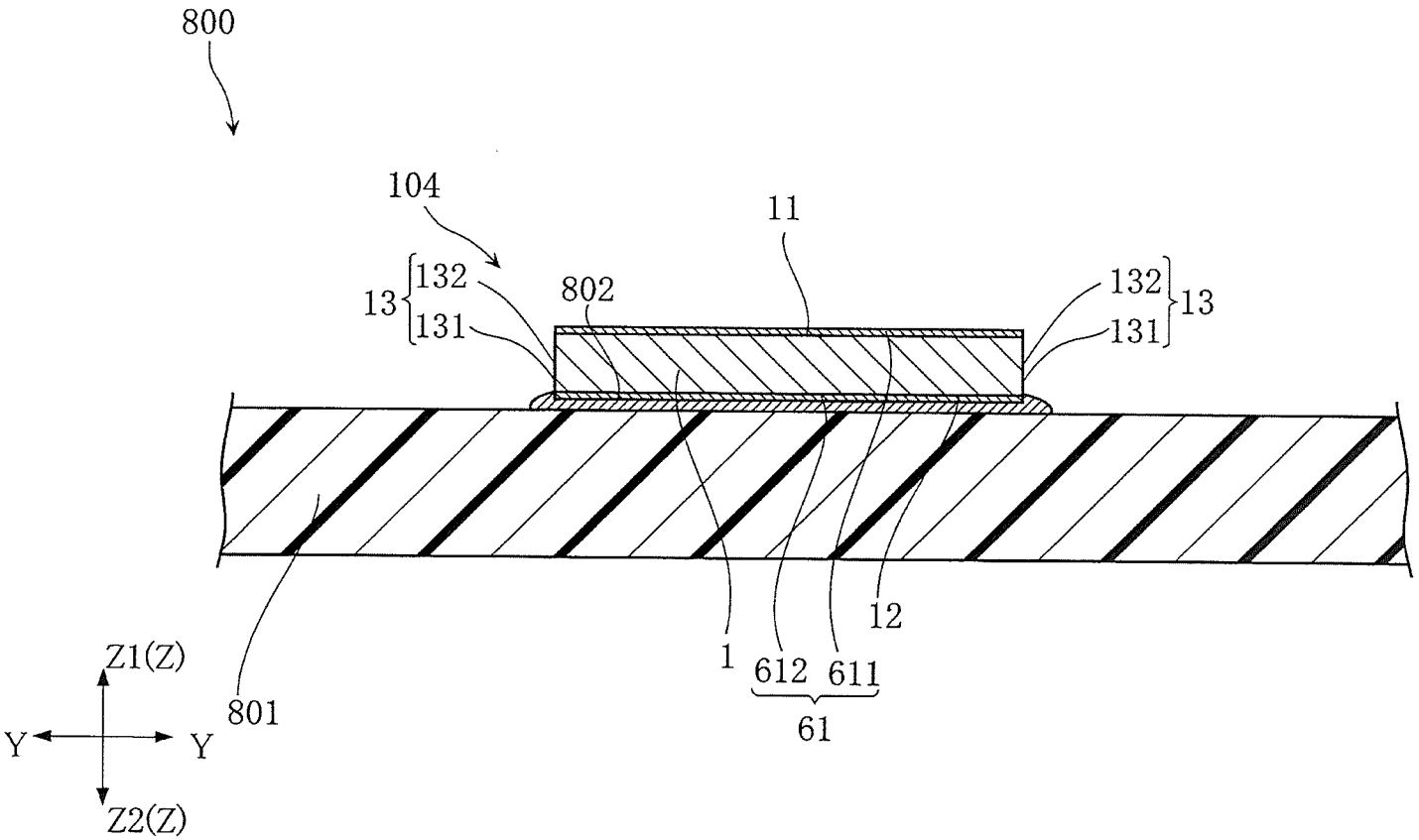
FIG. 30 is a sectional view taken along lines XXX-XXX in FIG. 29.
Figure 31:
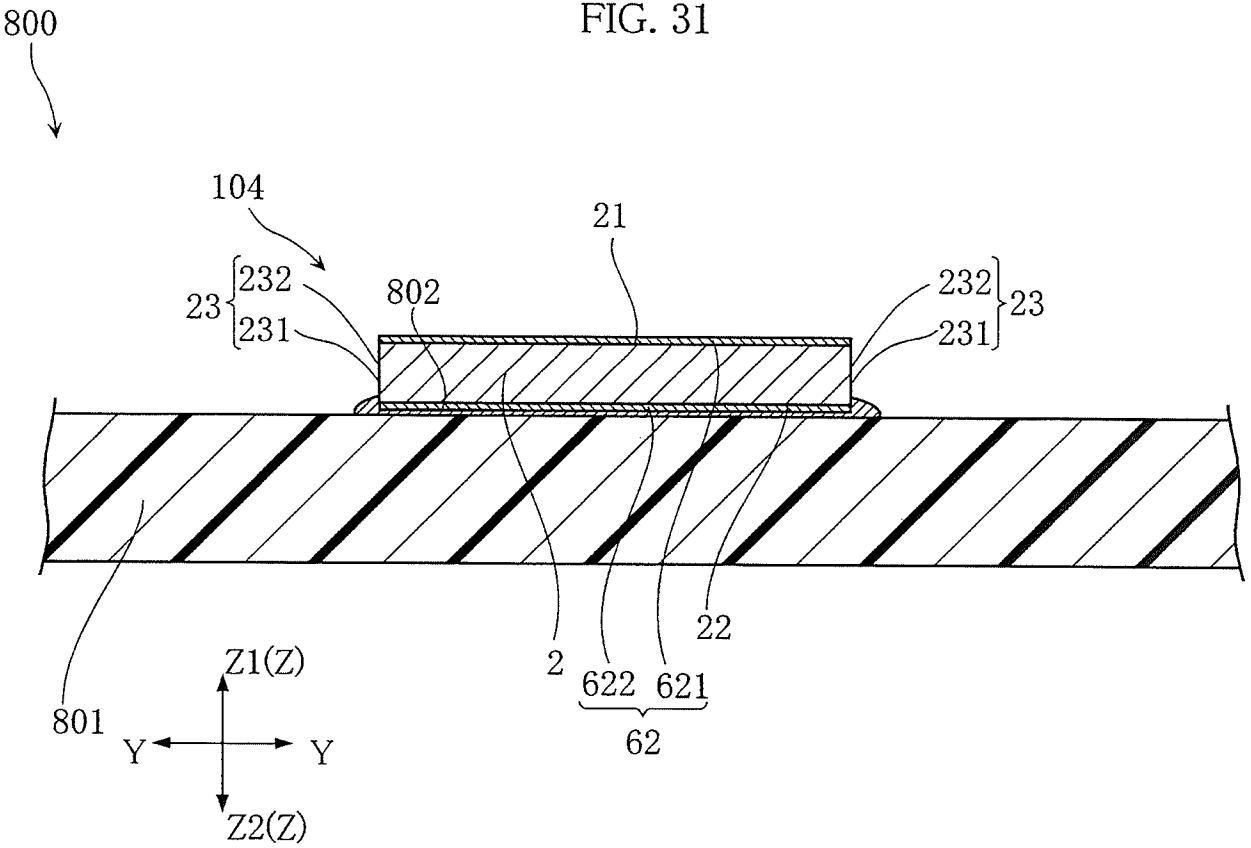
FIG. 31 is a sectional view taken along lines XXXI-XXXI in FIG. 29.
Figure 32:
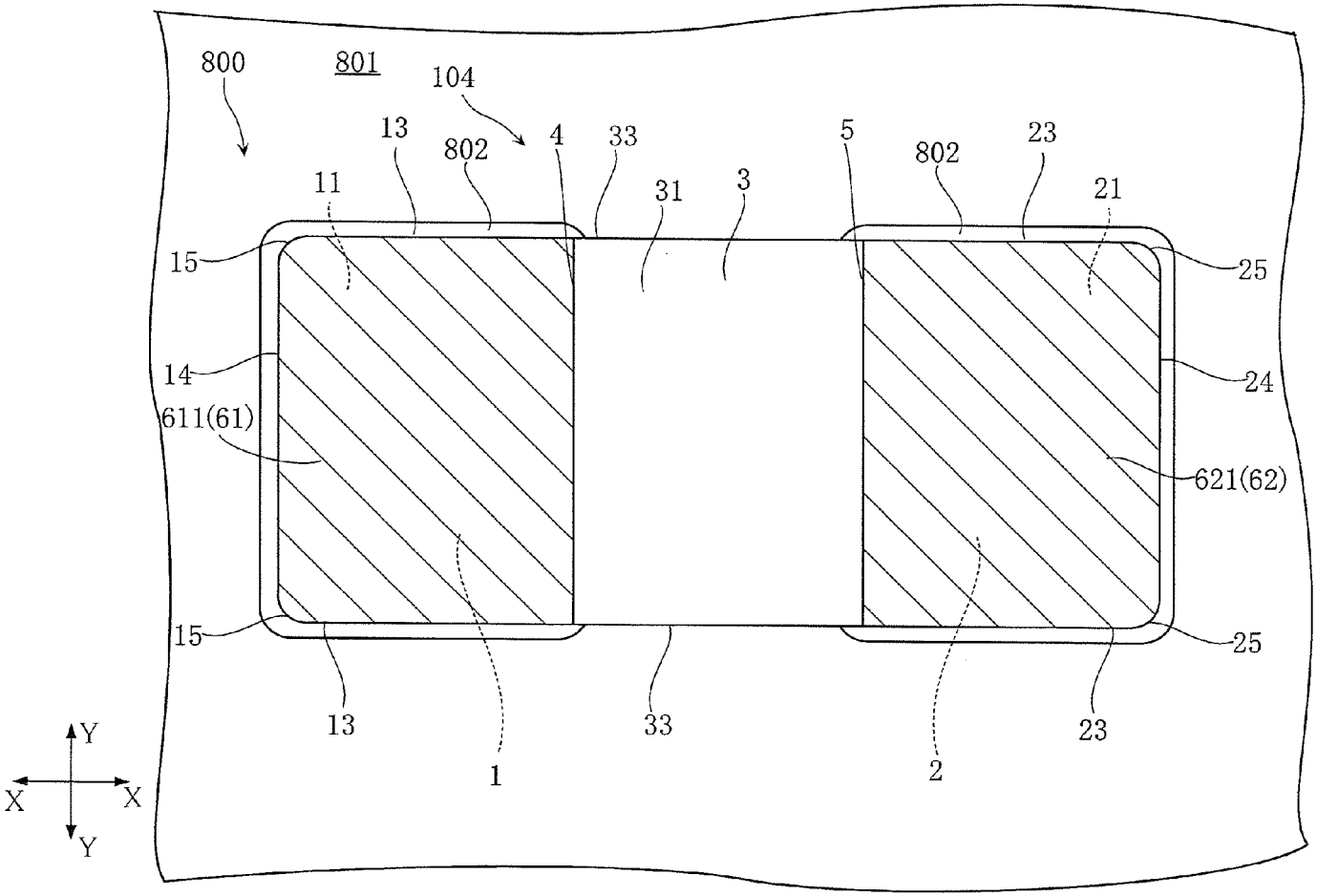
FIG. 32 is a plan view of a mount structure of the chip resistor shown in FIG. 29.
Figure 33:
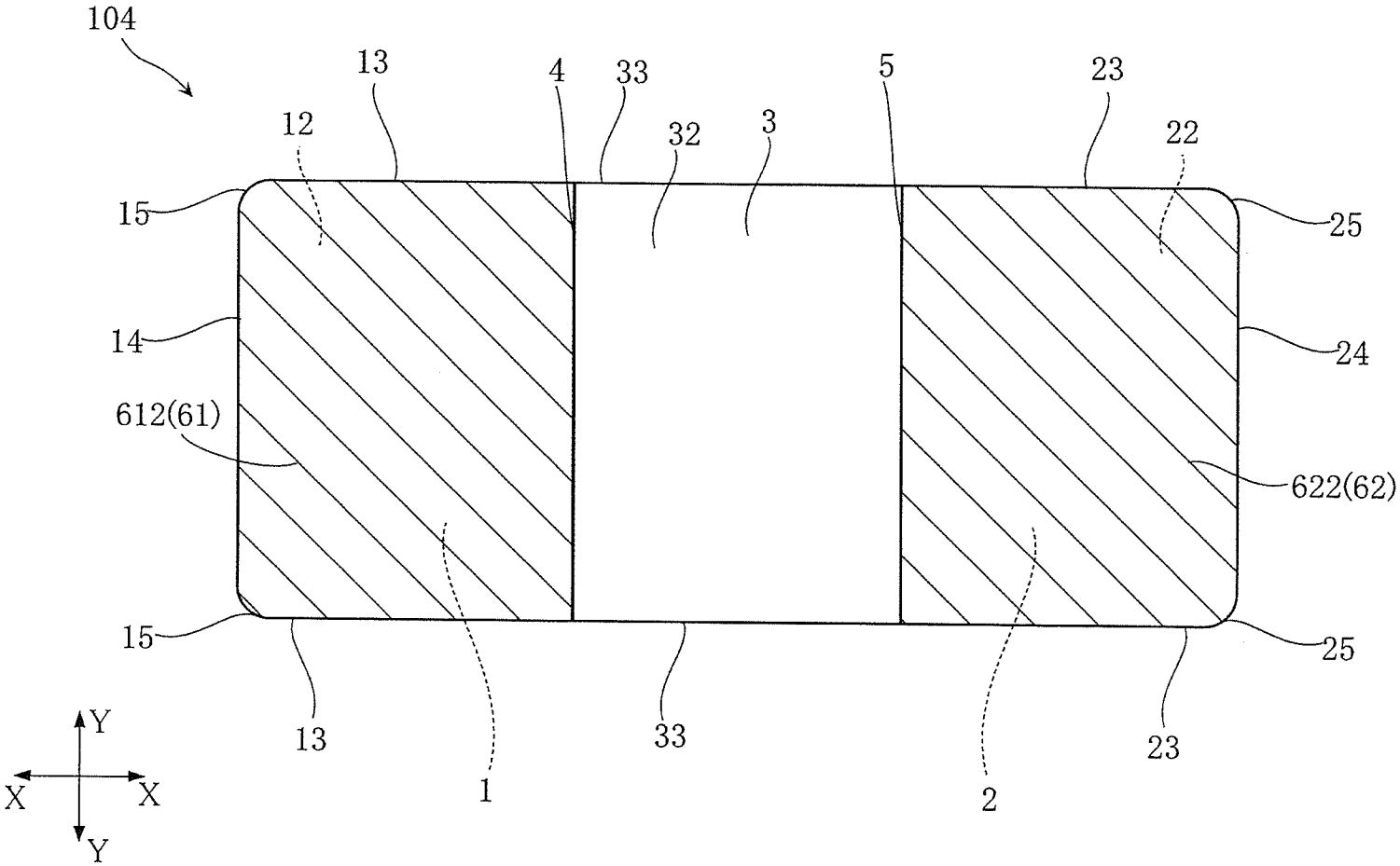
FIG. 33 is a view (partially omitted) along lines XXXIII-XXXIII in FIG. 29.

FIG. 29 is a sectional view of a mount structure of a chip resistor according to a second embodiment of the present invention. FIG. 30 is a sectional view taken along lines XXX-XXX in FIG. 29. FIG. 31 is a sectional view taken along lines XXXI-XXXI in FIG. 29. FIG. 32 is a plan view of the mount structure of the chip resistor of FIG. 29. FIG. 33 is a view (partially omitted) along lines XXXIII-XXXIII in FIG. 29.

The chip resistor 104 shown in these figures includes a first electrode 1, a second electrode 2, a resistor portion 3, a first intermediate layer 4, a second intermediate layer 5, a coating film 61, a coating film 62, oxides 691 (not shown in this embodiment, see FIG. 8), and oxides 692 (not shown in this embodiment, see FIG. 9). In FIGS. 32 and 33, the regions where the coating film 61, 62 are formed are indicated by hatching. The structures of the resistor portion 3 and the oxides 691, 692 are the same as those of the chip resistor 101, so that explanation of these elements are omitted.

The first electrode 1, the second electrode 2, the first intermediate layer 4, the second intermediate layer 5, the coating film 61 and the coating film 62 of this variation are the same as those of the above-described chip resistor 101 except the following points.

The thickness of the first electrode 1 and the second electrode 2 (dimension in the direction Z) is larger than the thickness of the resistor portion 3 (dimension in the direction Z). The first electrode 1 and the second electrode 2 each is in the form of a flat plate extending along the X-Y plane and does not include an inclined portion.

The first electrode 1 has an inner side surface 16, and the second electrode 2 has an inner side surface 26. The inner side surface 16 faces toward the second electrode 2, whereas the inner side surface 26 faces toward the first electrode 1. The inner side surface 16 and the inner side surface 26 face each other. Both of the inner side surface 16 and the inner side surface 26 are flat. The inner side surface 16 is covered by the coating film 61. The inner side surface 26 is covered by the coating film 62. The vertical direction of the first intermediate layer 4 and the second intermediate layer 5 is reversed to that in the chip resistor 101.

The method for manufacturing the chip resistor 104 is the same as the method for manufacturing the chip resistor 101 except that the thickness of the conductive elongated boards 711 (see FIG. 12) of the electrically conductive member 701 is larger than the thickness of the resistive elongated boards 721 (see FIG. 15) of the resistive member 702. Thus, the explanation is omitted. In the method for manufacturing the chip resistor 104, the step of bending the conductive elongated boards 711 is not performed.

According to this variation again, the same advantages as those of the chip resistor 101 are obtained.

In the chip resistor 104, the side surface 14 is not covered by the coating film 61. However, similarly to the first variation of the first embodiment, the side surface 14 of the chip resistor 104 may be covered by the coating film 61. Similarly, in the chip resistor 104, the side surface 24 may be covered by the coating film 62.

Third Embodiment

Figure 34:
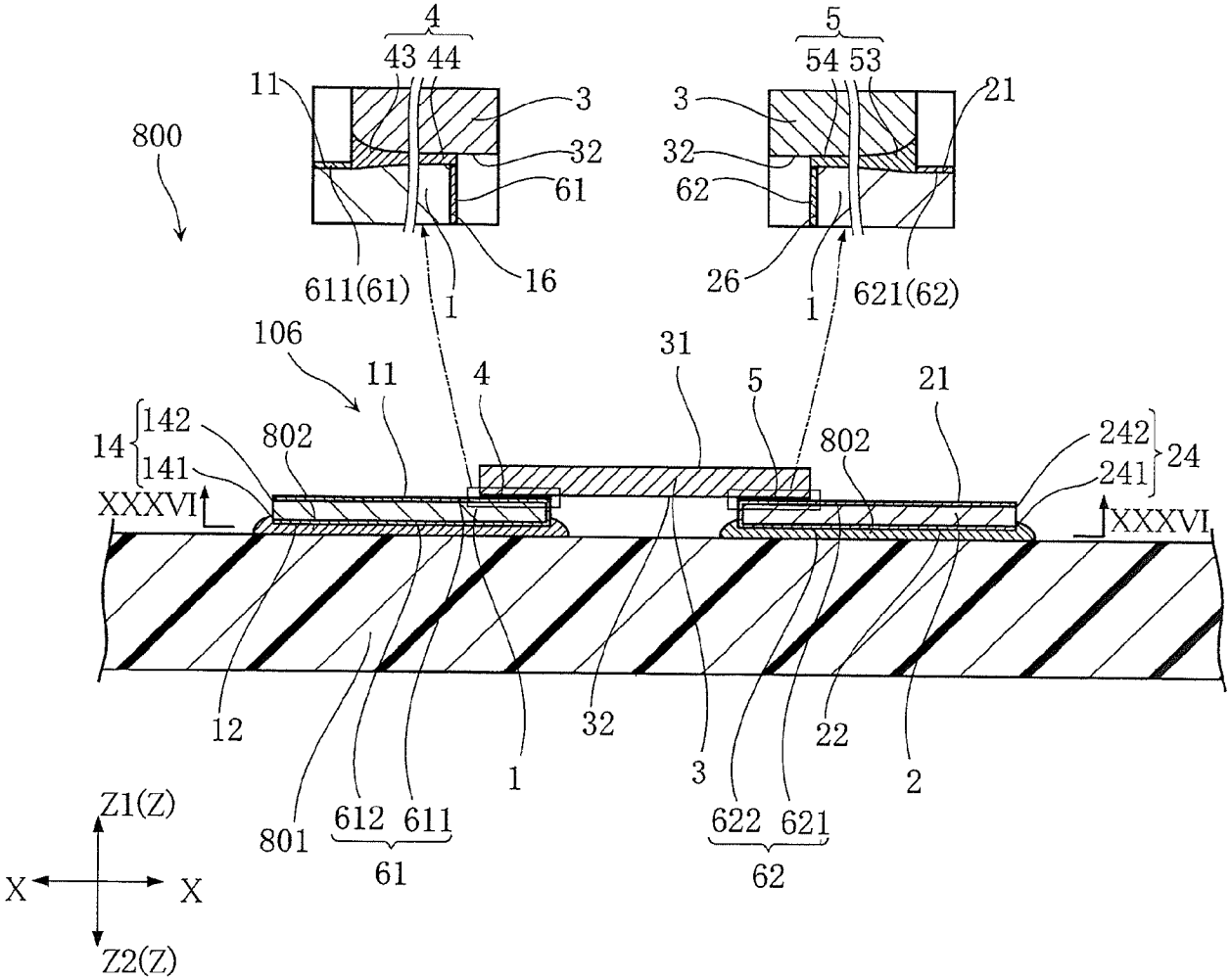
FIG. 34 is a sectional view of a mount structure of a chip resistor according to a third embodiment of the present invention.
Figure 35:
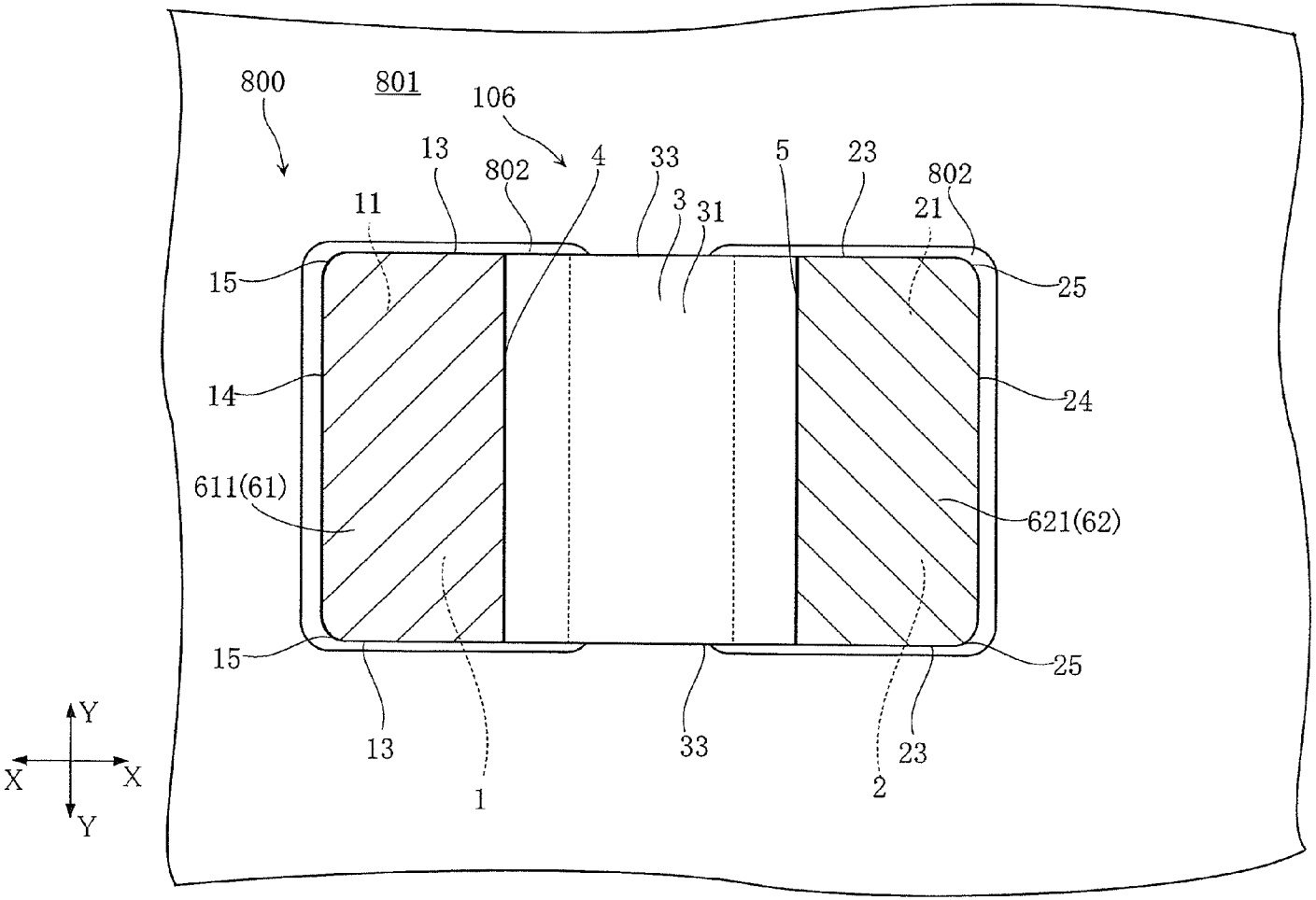
FIG. 35 is a plan view of the mount structure of the chip resistor shown in FIG. 34.
Figure 36:
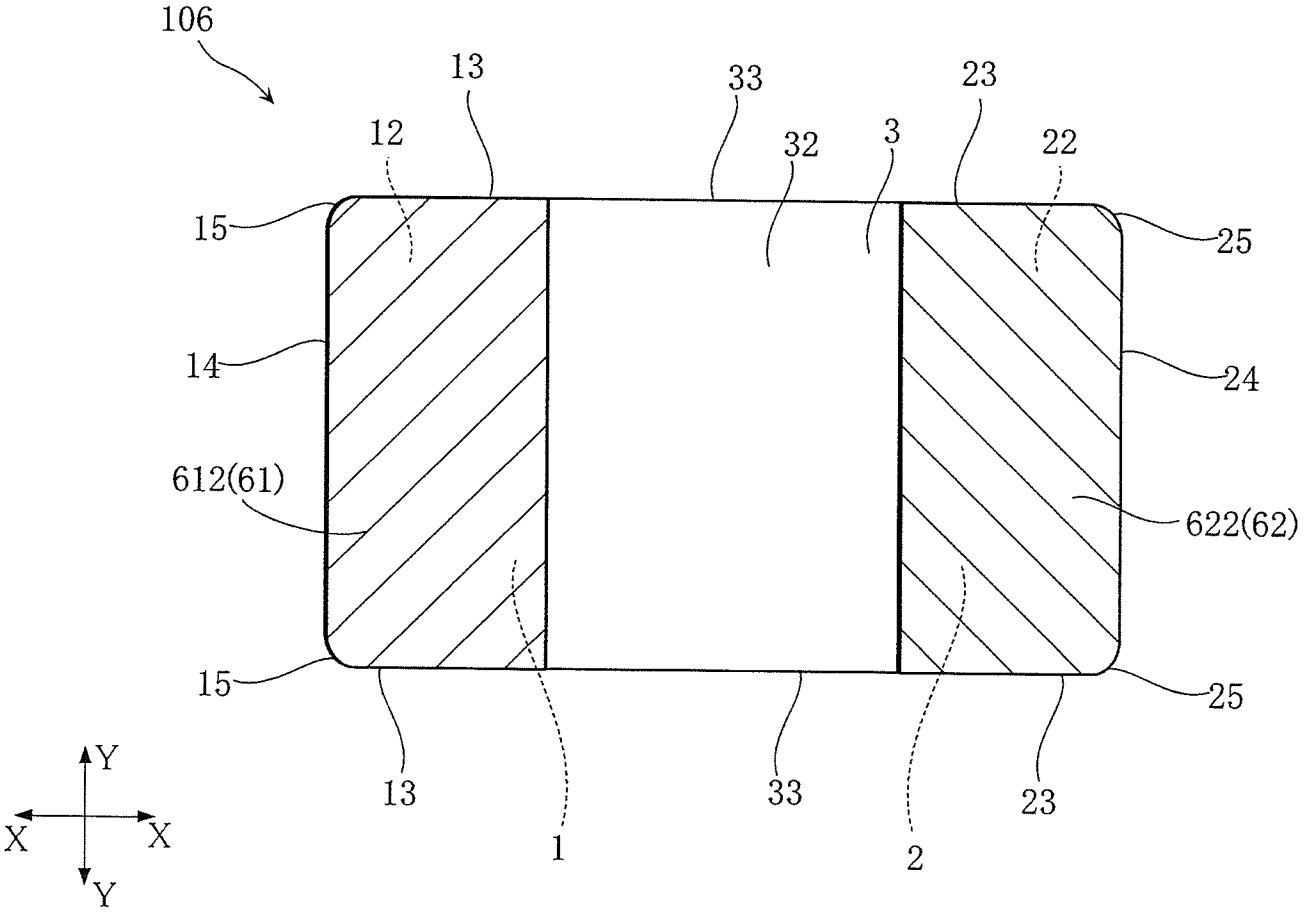
FIG. 36 is a view (partially omitted) along lines XXXVI-XXXVI in FIG. 34.

FIG. 34 is a sectional view of a mount structure of a chip resistor according to a third embodiment of the present invention. FIG. 35 is a plan view of the mount structure of the chip resistor of FIG. 34. FIG. 36 is a view (partially omitted) along lines XXXVI-XXXVI in FIG. 34.

The chip resistor 106 includes a first electrode 1, a second electrode 2, a resistor portion 3, a first intermediate layer 4, a second intermediate layer 5, a coating film 61, a coating film 62, oxides 691 (not shown in this embodiment, see FIG. 8) and oxides 692 (not shown in this embodiment, see FIG. 9). In FIGS. 35 and 36, the regions where the coating films 61, 62 are formed are indicated by hatching. The chip resistor 106 is substantially the same as the chip resistor 104 except the following points.

In the chip resistor 106, the first electrode 1 and the second electrode 2 are provided on a same side of the resistor portion 3. As shown in FIG. 34, the first intermediate layer 4 and the second intermediate layer 5 are elongated in the horizontal direction (direction X).

According to this variation, the same advantages as those of the chip resistor 101 are obtained.

When current flows through the chip resistor 106, the portion of the resistor portion 3 which overlaps the gap between the first electrode 1 and the second electrode 2 as viewed in plan (viewed in the direction Z) functions as a resistor. Thus, the resistance of the chip resistor 106 is determined by the distance between the first electrode 1 and the second electrode 2. By adjusting the distance between the first electrode 1 and the second electrode 2 in the state of the resistor aggregate 703, the resistance of the chip resistor 106 is finely adjusted. By finely adjusting the resistance of the chip resistor 106, the number of chip resistors 106 which require trimming reduces. This enhances the manufacturing efficiency of the chip resistor 106.

In the chip resistor 106, the side surface 14 is not covered by the coating film 61. However, similarly to the first variation of the first embodiment, the side surface 14 of the chip resistor 106 may be covered by the coating film 61. Similarly, the side surface 24 of the chip resistor 106 may be covered by the coating film 62.

The present invention is not limited to the foregoing embodiments. The specific structure of each part of the present invention may be varied in design in many ways.

Although an example in which the side surface 13 is not covered by the coating film 61 is shown, the side surface 13 may be covered by the coating film 61. Similarly, although an example in which the side surface 23 is not covered by the coating film 62 is shown, the side surface 23 may be covered by the coating film 62.

The chip resistor may be made without using a lead frame. For instance, the chip resistor may be made by bonding two separate bars made of an electrically conductive material and a bar made of a resistive material. Although a plurality of chip resistors are collectively punched in the foregoing embodiments, the chip resistors may be punched one by one. Though punching is preferable in terms of the merits described above, other techniques such laser cutting may be employed as the cutting method.

The chip resistor may be manufactured by using reels explained in terms of prior arts.

REFERENCE SIGNS

800 mount structure
801 mount board
802 solder layer
101, 102, 104, 106 chip resistor
1 first electrode
11 principal surface
12 principal surface
13 side surface
14 side surface
131 line-trace formed surface
141 line-trace formed surface
132 breakage-trace formed surface
142 breakage-trace formed surface
15 curved surface
151 line-trace formed surface
152 breakage-trace formed surface
16 inner side surface
181 plate-like portion
182 inclined portion
2 second electrode
21 principal surface
22 principal surface
23 side surface
24 side surface
231 line-trace formed surface
241 line-trace formed surface
232 breakage-trace formed surface
242 breakage-trace formed surface
25 curved surface
251 line-trace formed surface
252 breakage-trace formed surface
281 plate-like portion
282 inclined portion
3 resistor portion
31 resistor portion front surface
32 resistor portion reverse surface
33 resistor portion side surface
331 line-trace formed surface
332 breakage-trace formed surface
4 first intermediate layer
43 wide portion
44 narrow portion
49 recess
5 second intermediate layer
53 wide portion
54 narrow portion
59 recess
6 coating film
61 coating film
611 principal surface coating portion
612 principal surface coating portion
613 side surface coating portion
62 coating film
621 principal surface coating portion
622 principal surface coating portion
623 side surface coating portion
691, 692 oxides
701 electrically conductive member
702 resistive member
703 resistor aggregate
711 conductive elongated board
721 resistive elongated board
831 punching die
832 punching die
881 welding laser

The invention claimed is:

1. A chip resistor comprising:
a first electrode;
a second electrode spaced apart from the first electrode in a first direction;
a resistor portion bonded to the first electrode and the second electrode;
a first intermediate layer connected to the first electrode and the resistor portion;
a second intermediate layer connected to the second electrode and the resistor portion; and
a coating film covering the first electrode;
wherein the coating film is made of a material having a higher absorptance of a laser beam of a predetermined wavelength than that of a material forming the first electrode, and the first intermediate layer contains at least the material forming the coating film.

2. The chip resistor according to claim 1, wherein the coating film is made of Sn or solder.

3. The chip resistor according to claim 2, wherein the resistor portion extends along a plane spreading in the first direction and a second direction crossing the first direction,
the first electrode includes a first principal surface facing one side in a thickness direction of the resistor portion;
the coating film includes a first-principal-surface coating portion covering the first principal surface, the first-principal-surface coating portion covering the first principal surface over a region from an end closer to the second electrode in the first direction to an end opposite in the first direction from the end closer to the second electrode.

4. The chip resistor according to claim 3, wherein the first electrode includes a second principal surface facing away from the first principal surface, and
the coating film includes a second-principal-surface coating portion covering the second principal surface.

5. The chip resistor according to claim 4, wherein the second-principal-surface coating portion covers the second principal surface over a region from an end closer to the second electrode in the first direction to an end opposite in the first direction from the end closer to the second electrode.

6. The chip resistor according to claim 4, wherein the second-principal-surface coating portion is made of a same material as the material forming the first-principal-surface coating portion.

7. The chip resistor according to claim 3, wherein the first electrode includes a first side surface facing in the second direction, and the first side surface is exposed from the coating film.

8. The chip resistor according to claim 7, wherein the first side surface includes a line-trace formed surface formed with a line trace, and a breakage-trace formed surface connected to the line-trace formed surface and formed with a breakage trace.

9. The chip resistor according to claim 7, wherein the first electrode includes a second side surface and a curved surface connected to the first side surface and the second side surface,
the second side surface faces in a direction away from the resistor portion in the first direction, the second side surface and the curved surface being exposed from the coating film.

10. The chip resistor according to claim 7, wherein the first electrode includes a second side surface, and the second side surface faces in a direction away from the resistor portion in the first direction and is covered by the coating film.

11. The chip resistor according to claim 1, wherein the resistor portion is sandwiched between the first electrode and the second electrode.

12. The chip resistor according to claim 1, wherein the first intermediate layer includes a wide portion and a narrow portion that is smaller than the wide portion in dimension in the first direction, and the wide portion and the narrow portion are exposed in opposite directions from each other.

13. The chip resistor according to claim 1, wherein the first electrode includes a plate-like portion extending along the first direction and a second direction crossing the first direction, and an inclined portion inclined with respect to the plate-like portion and closer to the resistor portion than the plate-like portion is.

14. The chip resistor according to claim 1, wherein the first electrode and the second electrode are positioned on a same side of the resistor portion.

15. The chip resistor according to claim 1, wherein the resistor portion is smaller in thickness than the first electrode.

16. The chip resistor according to claim 1, further comprising oxide existing in the first intermediate layer, wherein the oxide is oxide of a material forming the coating film.

17. A mount structure of a chip resistor comprising:

the chip resistor as set forth in claim 1;

a mount board; and a solder layer provided between the mount board and the chip resistor.

18. A chip resistor manufacturing method comprising the steps of:

preparing an electrically conductive member made of an electrically conductive material and a resistive member made of a resistive material;

forming a coating film to cover the electrically conductive member; and bonding the electrically conductive member and the resistive member to each other by application of a laser beam of a predetermined wavelength after the step of forming the coating film, wherein the coating film is formed of a material having a higher absorptance of the laser beam of the predetermined wavelength than that of the electrically conductive material, and the bonding step comprises applying the laser beam to the coating film.

19. The chip resistor manufacturing method according to claim 18, wherein the coating film is made of Sn or solder.

20. The chip resistor manufacturing method according to claim 18, wherein the step of forming the coating film comprises plating.

21. The chip resistor manufacturing method according to claim 18, wherein the preparation step comprises preparing a plurality of conductive elongated boards as the electrically conductive member, the method further comprises the step of arranging the conductive elongated boards side by side in a width direction crossing a longitudinal direction of one of the conductive elongated boards before the bonding step, and the bonding step comprises bonding the resistive member to the conductive elongated boards to provide a resistor aggregate after the step of arranging.

22. The chip resistor manufacturing method according to claim 21, further comprising the step of dividing the resistor aggregate by punching to provide a chip resistor including two electrodes and a resistor portion bonded to the two electrodes.

* * * * *